US008662613B2

(12) United States Patent
Kato et al.

(10) Patent No.: US 8,662,613 B2
(45) Date of Patent: Mar. 4, 2014

(54) INKJET RECORDING SYSTEM AND INKJET RECORDING METHOD

(75) Inventors: Masao Kato, Kawasaki (JP); Okinori Tsuchiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 333 days.

(21) Appl. No.: 12/399,853

(22) Filed: Mar. 6, 2009

(65) Prior Publication Data

US 2010/0060685 A1 Mar. 11, 2010

(30) Foreign Application Priority Data

Mar. 7, 2008 (JP) ..... 2008-057307

(51) Int. Cl.
*B41J 29/38* (2006.01)
*B41J 2/15* (2006.01)
*B41J 2/135* (2006.01)

(52) U.S. Cl.
USPC ..... 347/12; 347/40; 347/44

(58) Field of Classification Search
USPC ..... 347/43–44, 40, 10–12
See application file for complete search history.

(56) References Cited

U.S. PATENT DOCUMENTS

| | | | | |
|---|---|---|---|---|
| 6,966,621 | B2 | 11/2005 | Takahashi | |
| 7,350,893 | B2 | 4/2008 | Teshigawara | |
| 7,390,072 | B2 | 6/2008 | Takahashi | |
| 7,554,697 | B2 * | 6/2009 | Mizutani et al. | 358/3.12 |
| 7,880,929 | B2 * | 2/2011 | Kaneko et al. | 358/1.9 |
| 2004/0070638 | A1 | 4/2004 | Takahashi | |
| 2005/0243113 | A1 | 11/2005 | Takahashi | |
| 2007/0002096 | A1 * | 1/2007 | Teshigawara et al. | 347/37 |
| 2007/0285451 | A1 * | 12/2007 | Noguchi | 347/12 |
| 2008/0049055 | A1 * | 2/2008 | Edamura et al. | 347/9 |

* cited by examiner

*Primary Examiner* — Jason Uhlenhake
(74) *Attorney, Agent, or Firm* — Canon USA, Inc. IP Division

(57) ABSTRACT

An inkjet recording system including a separation unit configured to obtain separated data which corresponds to each of a plurality of nozzle arrays from input image data, a gradation correction unit configured to perform gradation correction by one-dimensional conversion on the separated data obtained by the separation unit, and a quantization unit configured to quantize the data on which the gradation correction is performed by the gradation correction unit to generate the recording data, wherein the separation unit obtains the separated data so that first separated data and second separated data corresponding to at least a pair of nozzle arrays for adjusting an effect of an air current have a same value, and the gradation correction unit performs different gradation correction on the first separated data and the second separated data which have the same value.

20 Claims, 21 Drawing Sheets

FIG. 20

| INPUT | RECORDING DOTS | INK DISCHARGE AMOUN |
|---|---|---|
| Level 0 (000) | | 0 ng |
| Level 1 (001) | | 2 ng |
| Level 2 (010) | | 4 ng |
| Level 3 (011) | | 7 ng |
| Level 4 (100) | | 9 ng |
| Level 5 (101) | | 12 ng |
| Level 6 (110) | | 15 ng |
| Level 7 (111) | | 20 ng |

INKJET RECORDING SYSTEM AND INKJET RECORDING METHOD

BACKGROUND OF THE INVENTION

1. Field of the Invention

The present invention relates to an inkjet recording system and an inkjet recording method for recording images on various recording media, using a recording head in which a plurality of nozzle arrays are formed, by discharging ink droplets from the nozzles in the nozzle arrays while moving the recording head.

The present invention is applicable to any piece of equipment using a recording medium such as paper, cloth, leather, nonwoven fabric, an overhead projector (OHP) sheet, and even metal. Specifically, present invention is applicable to office equipment such as printers, copying machines, and facsimile machines, as well as industrial production equipment.

2. Description of the Related Art

Office automation (OA) equipment such as personal computers and word processors are now widely spread. Various recording apparatuses and methods have thus been developed to record information which is input by these pieces of equipment on various recording media. In particular, with the improvements in information processing capabilities of such OA equipment, the processed image information tends to be in color. This trend toward color output is progressing even for recording apparatuses which output processed information. Various recording apparatuses capable of recording color images are available according to costs and functions. Some recording apparatuses are inexpensive with relatively simple functions, while others have a large number of functions which enable a user to select a recording speed and image quality depending on a type of images to be recorded or the intended use.

Inkjet recording apparatuses can be low-noise, low running cost, and compact, and can easily record an image in color. The inkjet recording apparatuses are thus widely utilized in printers, copying machines, facsimile machines and the like. Generally, color inkjet recording apparatuses record color images using three color inks, cyan, magenta, and yellow inks, or four color inks, these three inks plus black ink. Conventional inkjet recording apparatuses generally use special paper which has an ink absorbing layer as a recording medium to record color images with excellent color development free from ink bleeding. Currently, improved inks with properties suitable for recording on "plain paper", which is used in large quantities by printers, copying machines and the like are practically used.

Serial scan type inkjet recording apparatuses employ an inkjet recording head in which nozzle groups corresponding to each of ink colors used in recording are provided to perform color recording using a plurality of color inks. The recording head can discharge the ink from discharge ports constituting the nozzles. The serial scan type inkjet recording apparatuses sequentially record images on the recording medium by alternately repeating an operation of discharging the ink from the discharge ports in the recording head while moving the recording head in a main scanning direction, and an operation of conveying the recording medium in a sub-scanning direction which intersects the main scanning direction. Thus, a lateral configuration recording head is used in which nozzle groups (nozzle groups to be used) corresponding to each of the ink colors used in recording are sequentially laterally arranged along the main scanning direction. The lateral configuration recording head can discharge ink droplets from the respective nozzle groups onto a same raster during a same recording scan.

To realize high-resolution recording to record higher quality images, it is effective to employ a high-density recording head in which recording elements of the recording head, including the nozzles, are more densely integrated for the lateral configuration head in the inkjet recording apparatuses. Nowadays, even high-density recording heads with nozzle arrays of 600 dpi (about 42.3 μm) are produced by employing semiconductor processes.

Moreover, recording heads are produced in which, to arrange the nozzles at an even higher density, a plurality of nozzle arrays corresponding to each ink color is provided in parallel and arranged so that positions of the nozzles in those nozzle arrays are offset by a predetermined amount in the sub-scanning direction. For example, if two nozzle arrays each of which has a nozzle arrangement density of 600 dpi are arranged in parallel such that the positions of the nozzles in those two nozzle arrays are displaced from each other to achieve 1,200 dpi (about 21.2 μm) in the sub-scanning direction, this results in a recording head with a high density of 1,200 dpi.

Another method for recording higher-quality images is to reduce a size of each ink droplet for image recording. To reduce the size of the droplet, it is effective to use a recording head with downsized recording elements, including nozzles, capable of discharging smaller ink droplets. Today, recording heads suitable for high-definition recording which can discharge ink in 4 to 5 pl amounts are produced.

Thus, higher-quality images can be recorded by discharging smaller ink droplets from densely arranged nozzles.

However, when the lateral configuration recording head is used, the ink discharges from the respective nozzles in the plurality of nozzle arrays lined up in the main scanning direction may affect one another. Ink droplets discharged from the nozzles draw in the surrounding air. Thus, when the recording head is moved at a high speed in the main scanning direction simultaneously with the discharge of a large number of ink droplets, an air flow (air current) is generated, which may adversely affect the discharge of the ink.

A mechanism of generation of an air current will be described in more detail. First, with reference to FIG. 1, the generation of the air current resulting from operation of the recording head will be described.

FIG. 1 illustrates a discharge port forming surface of a recording head H viewed from above. Discharge ports constituting nozzles N are formed on the discharge port forming surface. Nozzle arrays L1 and L2 both discharge ink in a direction orthogonal to a sheet surface of FIG. 1 from their nozzles N. The recording head H records by discharging ink from the nozzles N in the nozzle arrays L1 and L2 while moving in the main scanning direction illustrated by an arrow X in FIG. 1. At this stage, ink droplets discharged vertically below the nozzles N in the nozzle array L1 draw in the surrounding air to form a "gas wall" that moves as if in the direction of the arrow X. Movement of the "gas wall" in the direction of the arrow X generates the air current flowing into a back of the "gas wall" in directions of arrows A in FIG. 1. The air current flows toward a front of the nozzle array L2, which adversely affects the ink droplets discharged from the nozzles N in the nozzle array L2. This can result in the discharge direction shifting.

FIG. 2 illustrates the recording head H viewed from a side direction and the air current behind the "gas wall". Ink droplets discharged from the nozzles N in the nozzle arrays L1 and L2 in a direction of arrows B cause a downward air current.

The direction of the air current may change near a recording medium W to a rearward direction as illustrated by the arrows A.

FIG. 3 illustrates the recording head H viewed from the front in the main scanning direction. FIG. 3 focuses on the nozzle array L2. In FIG. 3, ink droplets discharged from the nozzles located at an end (end nozzles) of the nozzle array L2 may have their discharge direction bent to the inward of the nozzle array L2 as the ink droplets approach the recording medium W due to the influence of the air current in the direction of the arrows A.

If such bending occurs, the ink droplets discharged from the end nozzles impact the recording medium W at positions that are deviated from the proper impacting positions to the inward of the nozzle array L2. This is recognized as an image defect similar to cases where a shift (bias) occurs in the discharge direction of the ink droplets, or ink droplets are not discharged. The discharge direction of the ink droplets discharged from the end nozzles is bent due to the effects of both the air current flowing behind the "gas wall" as illustrated in FIG. 1 and the air current generated from ink discharge as illustrated in FIG. 2.

Thus, the recording apparatuses which employ the conventional lateral configuration recording head may cause image defects due to air currents resulting from the discharge of ink droplets.

Japanese Patent Application Laid-Open No. 2004-142452 discusses a technology relating to effects of air currents in inkjet recording apparatuses. For a multipass recording system that records an image in a predetermined region by a plurality of scans of a recording head, the document discusses a method for controlling an applied ink amount by considering a relationship between a number of scans (number of passes) and a level of adverse effects of an air current. That is, to avoid the adverse effects from the air current, the applied ink amount is controlled based on the number of passes.

Further, in Japanese Patent Application Laid-Open No. 2004-142452, occurrence of the adverse effects on an image due to the air current is avoided without increasing the number of passes, by limiting recording conditions of ink droplets between nozzle arrays which are especially susceptible to the effects of air currents. Japanese Patent Application Laid-Open No. 2004-142452 discusses ink droplets of same color in different sizes, in which as illustrated in FIG. 18, recording dots are limited and applied to a left below region of a curve 801 between a recording nozzle array 1 (large dots) and a recording nozzle array 2 (small dots).

Further, to respond to a demand for higher speed recording of recent years, a driving frequency of the recording head can be improved. In other words, a moving speed of the recording head is increased in the main scanning direction. In this case, a level of the above-described air current effect changes according to the moving speed of the recording head. For example, when the same number of passes is recorded and the moving speed of the recording head is different, the level of the air current effect on the discharged ink droplets will substantially change. Obviously, the level of the air current effect increases when the recording head moves at a higher speed. As a result, impact precision of the ink on the recording medium may worsen and cause image quality deterioration.

Japanese Patent Application Laid-Open No. 2006-21532 discusses a technique for differentiating an amount of ink applied on a paper surface per unit region of the ink droplets discharged from a plurality of nozzle arrays of the recording head based on the recording speed. In this example, different air current limitation conditions for each recording speed are provided as illustrated in FIG. 10. To realize these conditions, different recording data generation curves for each recording speed are discussed as illustrated in FIGS. 21A to 21C.

Japanese Patent Application Laid-Open Nos. 2004-142452 and 2006-21532 respectively discuss two data generation methods for limiting an air current between same-color, different-amount ink droplets.

<Technique 1>

Japanese Patent Application Laid-Open No. 2004-142452 discusses an index method, in which limitation conditions are satisfied by an index pattern. An original image on a host computer is subjected to necessary color conversion processing (first-stage processing for compressing image data expressed in standard color space into a printer color gamut, second-stage processing for separating the image data compressed into the printer gamut into ink colors, gradation correction, and quantization) to generate recording information which has undergone multi-valued quantization for each of the ink colors (CMYK). In a printer engine, the received multi-valued recording information data for each of the ink colors is converted into ink dot data to be applied on the paper surface. As illustrated in FIG. 20, how large and small dots are used (index pattern) in a 2×2 recording pixels is defined for each level of the quantized multi-valued data so that the index pattern is always positioned in an OK region of FIG. 18. FIG. 19 illustrates a graph obtained by plotting the index patterns of FIG. 20 on FIG. 18. The dashed line 802 in FIG. 19 is a line linking between the respective quantization levels. Thus, actually generated data exists somewhere on the line 802.

<Technique 2>

Japanese Patent Application Laid-Open No. 2006-21532 discusses color separation processing which has another SC and SM for each plane for cyan ink and magenta ink in addition to CMYK in the second-stage (color separation) processing when RGB data is converted into the ink colors after the first-stage processing, as illustrated in the block diagram of FIG. 8. The color separation processing is virtually performed for a total of six colors, CMYKSCSM. Further, in Japanese Patent Application Laid-Open No. 2006-21532, the color separation processing is performed using a three-dimensional table and linear interpolation. C and M are given as the data for the large ink droplets, and SC and SM are given as the data for the small ink droplets. The generation conditions for the C and SC, and the M and SM tables are determined to form the dots within an OK region of a limitation curve of each recording speed by changing the limitation curve as illustrated in FIG. 10 based on the recording speed.

However, the techniques satisfying the above limitation conditions have the below-described problems. First, in the technique 1, in the large dot region of 0 to 1 dot in the OK region, a transition in combination of large and small dots occurs in a region significantly below the limitation conditions based on the air current (the solid line in FIG. 19). It is known that a grainy effect of the image is generally better if the large ink droplets are used after using many small ink droplets. In FIG. 19, when there is one large dot, it is desired to record with about 2.5 dots of the small dots, which is just on the air current control line. However, in the case of the technique 1, because the index pattern can only be defined as an integer of the number of dots, the maximum number of small dots which can be used for one large dot is up to two dots. More specifically, when one large dot is discharged, discharging three small dots would be in a no good (NG) region. Thus, the combination of one large dots and three small dots cannot be selected. As a result, the grainy effect is worse than the maximum value on the air current limitation line of 2.5 dots.

Further, the technique 2 performs the color conversion of the input (R, G, B) values into CMYKSCSM using the three-dimensional table and interpolation processing. In this case, if respective (C, M, Y, K, SC, SM) values corresponding to all of the (R, G, B) values of the input data are stored, the data amount is extremely large. Thus, to avoid this, only the (C, M, Y, K, SC, SM) values on points which predetermined (R, G, B) values are discrete (commonly referred to as "grid points") are stored, and the other (RGB) values are calculated by interpolating based on the (C, M, Y, K, SC, SM) value of the grid points adjacent thereto. Generally, from a calculation speed perspective, linear operation processing is used for the interpolation calculation.

In the technique 2, by generating the (C, M, Y, K, SC, SM) value for each grid point such that it does not exceed the air current control line during the three-dimensional table generation, the air current effects on the image can be prevented. However, even if the (C, M, Y, K, SC, SM) values on the grid points are on the air current control line illustrated in FIG. 10, at the points other than the grid points determined by the interpolation processing, the (C, M, Y, K, SC, SM) values may exceed the air current control line and lie in the NG region.

This problem is not limited to a linear interpolation calculation. Interpolation algorithm and air current generation mechanism have absolutely no relationship to each other. Thus, there is no interrelationship between the air current control line determined by the results of the air current generation mechanism and the interpolation calculation technique. Accordingly, just because the grid point satisfies the air current control line does not mean that the data determined by the interpolation results satisfies the air current limitation conditions. As a result, a region which satisfies the air current control line may be affected by an air current on the image and a part of the image, which is originally good, may be lost.

The (C, M, Y, K, SC, SM) values of the grid points could be generated so that the points other than the grid points are not affected by the air current while considering the interpolation algorithm. However, to perform this control to generate the grid points while satisfying all three-dimensional directions is very complex and time consuming. Producing such system is laborious, and there is no guarantee that an optimum image for the user will be obtained.

Thus, with the conventional techniques for realizing air current control, there is no guarantee that an optimum image will be formed free from the effects of an air current.

SUMMARY OF THE INVENTION

The present invention is directed to an inkjet recording system and method which can record an optimum image by generating recording data within air current control conditions so that an air current effect due to ink discharge is not produced. Further, the present invention is directed to a recording apparatus which performs this recording method.

According to an aspect of the present invention, an inkjet recording system which records an image using an inkjet recording apparatus that includes a recording head in which a plurality of nozzles capable of discharging ink droplets forms a plurality of nozzle arrays in a predetermined direction, and records an image on a recording medium by discharging the ink droplets from the plurality of nozzle arrays based on recording data in which input image data is converted so as to correspond to each of the plurality of nozzle arrays, while moving the recording head in a direction which intersects the predetermined direction. The inkjet recording system includes a separation unit configured to obtain separated data which corresponds to each of the plurality of nozzle arrays from the input image data, a gradation correction unit configured to perform gradation correction by one-dimensional conversion on the separated data obtained by the separation unit, and a quantization unit configured to quantize the data on which the gradation correction is performed by the gradation correction unit to generate the recording data, wherein the separation unit obtains the separated data so that first separated data and second separated data corresponding to at least a pair of nozzle arrays for adjusting an effect of an air current have a same value, and the gradation correction unit performs different gradation correction on the first separated data and the second separated data which have the same value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 20 illustrates a conventional index pattern.

DETAILED DESCRIPTION OF THE EMBODIMENTS

Various exemplary embodiments, features, and aspects of the invention will be described in detail below with reference to the drawings.

An embodiment of the present invention is an application example as a serial printer type inkjet recording apparatus having a plurality of recording heads.

Figure 1:
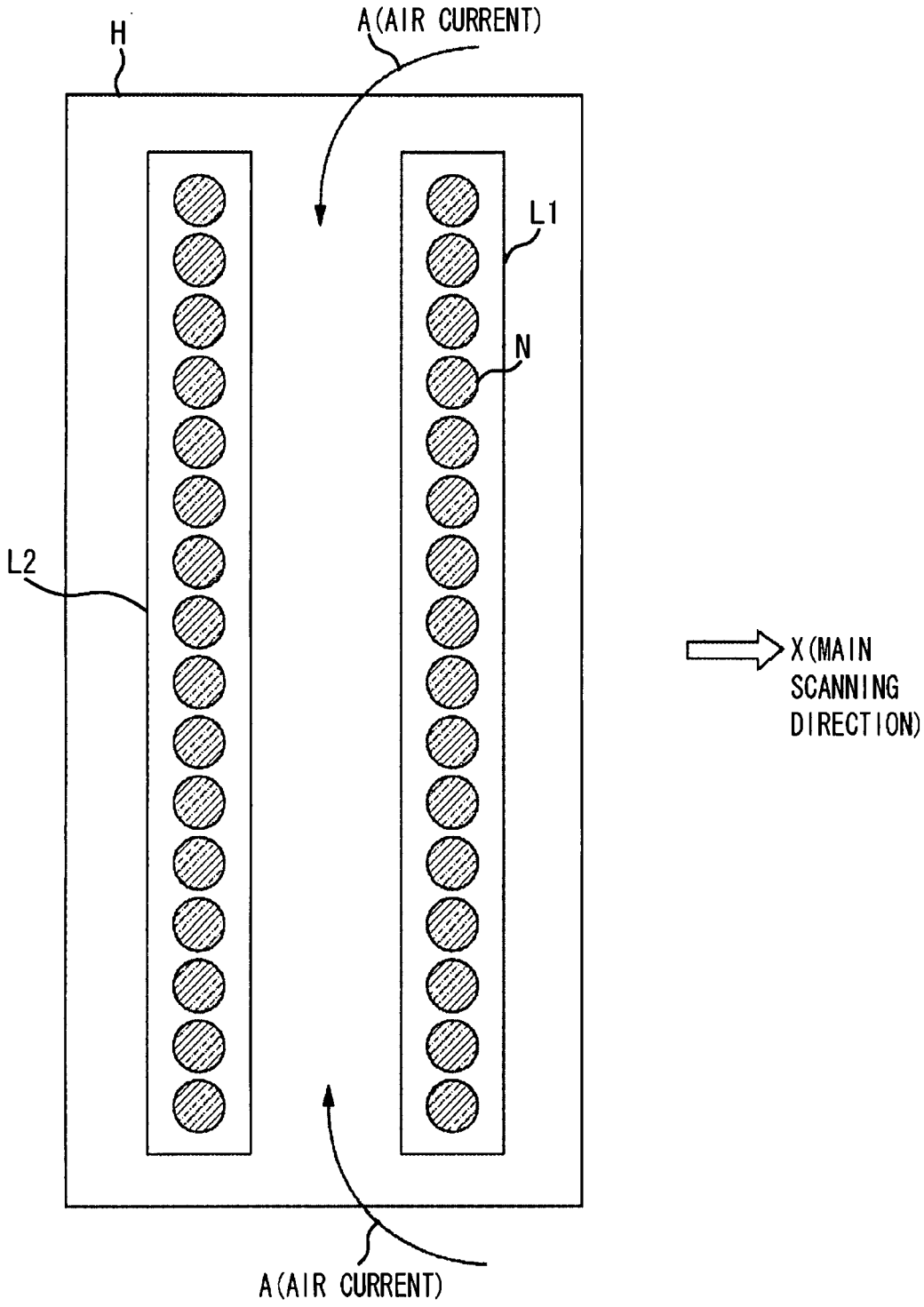
FIG. 1 illustrates a recording head viewed from above.
Figure 2:
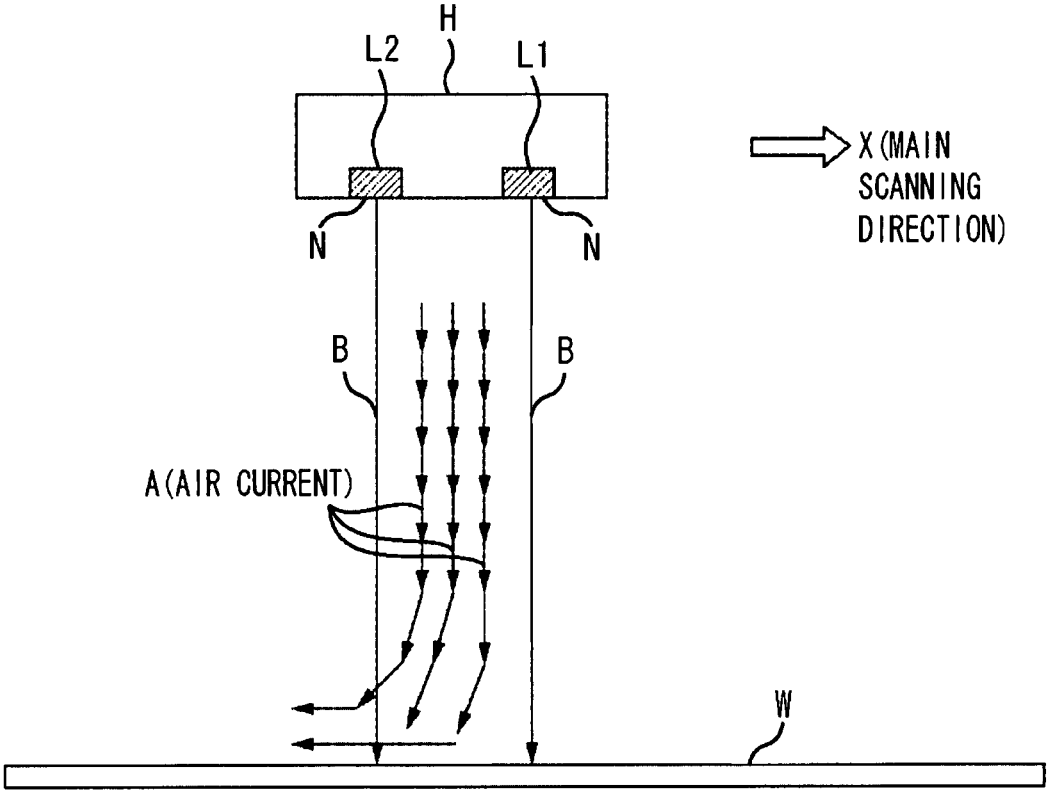
FIG. 2 illustrates the recording head viewed from a side direction for illustrating generation of an air current.
Figure 3:
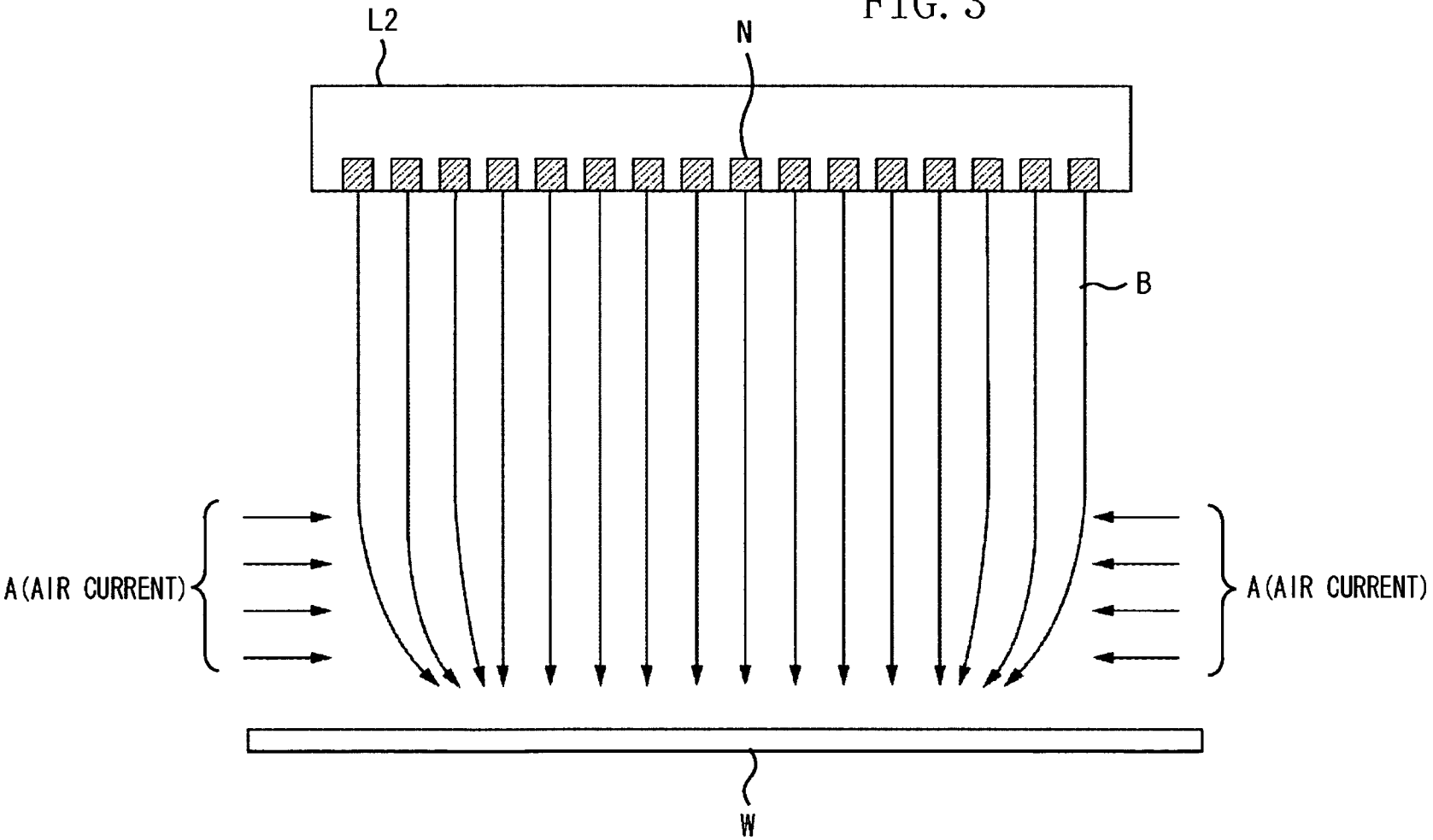
FIG. 3 illustrates the recording head viewed from a traveling direction for illustrating generation of the air current.
Figure 4:
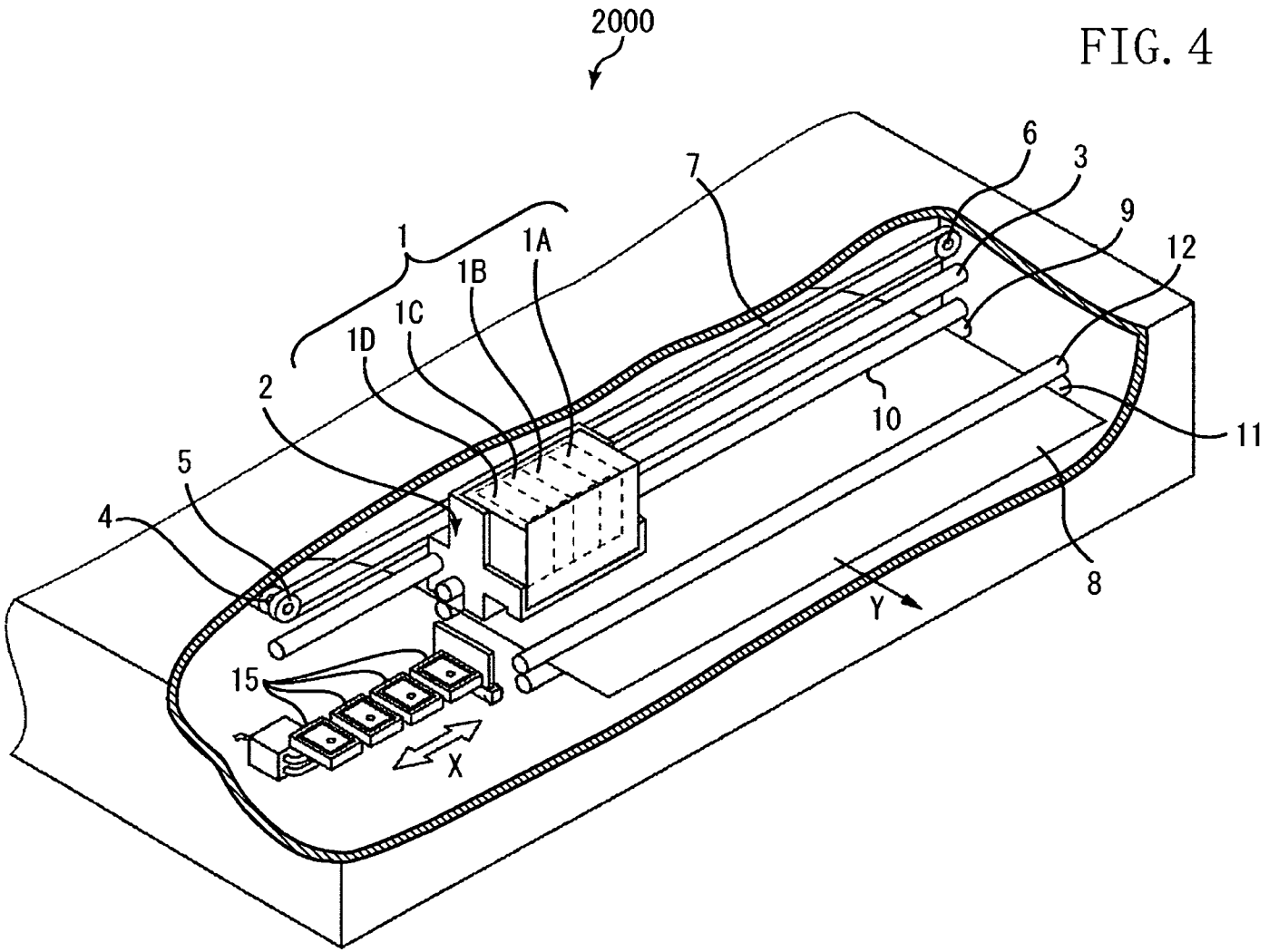
FIG. 4 is a partially cutaway perspective view of an inkjet recording apparatus to which the present invention can be applied.

FIG. 4 is a perspective diagram of main units of the inkjet recording apparatus to which the present invention can be applied.

In FIG. 4, a plurality of (four) head cartridges 1A, 1B, 1C, and 1D are replaceably mounted on a carriage 2. Each of the cartridges 1A to 1D includes a recording head that can discharge ink, an ink tank unit that supplies ink to the recording head, and a connector for receiving a signal which drives the recording head. In the description below, all of or an arbitrary one of the head cartridges 1A to 1D is referred to as a "recording head 1".

The head cartridges 1A to 1D are used for recording in different color inks. The ink tank units of the head cartridges 1A to 1D store different inks, such as cyan (C), magenta (M), yellow (Y), and black (Bk) inks. The head cartridges 1A to 1D are replaceably mounted on the carriage 2. The carriage 2 includes a connector holder (electric connecting unit) for transmitting driving signals to the respective recording heads via the connectors on the cartridges 1A to 1D.

The carriage 2 is guided by a guide shaft 3 installed in the apparatus main body so as to be movable in a main scanning direction shown by an arrow X. The carriage 2 is driven by a main scanning motor 4 via a motor pulley 5, a driven pulley 6, and a timing belt 7, and its position and movement are controlled. A recording medium 8, such as a paper sheet or a plastic thin plate is conveyed (fed) by rotation of two sets of conveyance rollers 9, 10 and 11, 12 through a position (recording unit) which faces a discharge port surface of the recording head 1.

The discharge port surface of the recording head 1 is a surface on which the discharge ports constituting the nozzles are formed. The recording head 1 can discharge ink droplets from the discharge ports. The recording medium 8 is supported on its back by a platen (not-illustrated) so as to form a flat recording surface in the recording unit. The discharge port surface of the recording head 1 in each of the cartridges mounted on the carriage 2 projects downward from the carriage 2 and faces the recording surface of the recording medium 8 between the two sets of conveyance rollers 9, 10 and 11, 12.

The recording head 1 is an inkjet recording head that utilizes thermal energy to discharge ink. The recording head 1 has an electrothermal converter (heater) for generating thermal energy. More specifically, the thermal energy generated by the electrothermal converter is used to cause film boiling in the ink in the nozzles. Ink droplets are discharged from the discharge ports by utilizing pressure changes caused by growth and contraction of bubbles at that stage. The ink discharge method in the recording head 1 is not limited to the above. For example, a method in which the ink is discharged using a piezoelectric element or the like may be employed.

Figure 5:
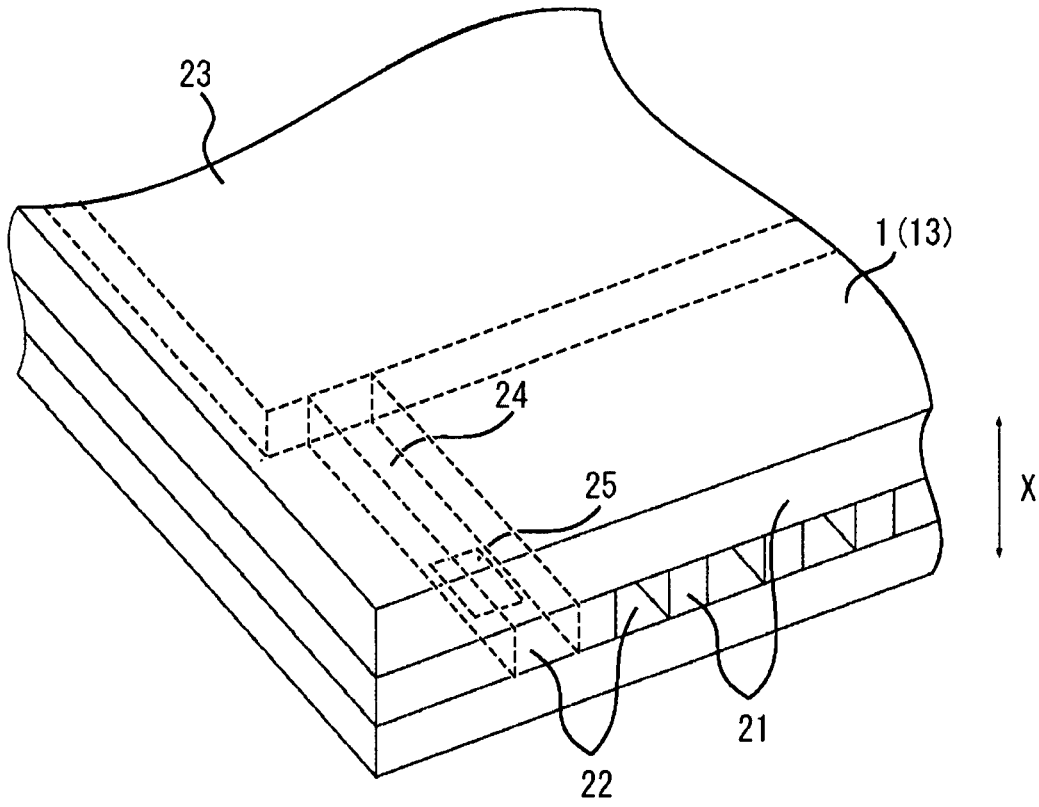
FIG. 5 is a perspective view illustrating an ink discharge unit of a recording head according to an exemplary embodiment of the present invention.

FIG. 5 is a perspective view of main parts of the ink discharge unit 13 in the recording head 1 of the present exemplary embodiment. In FIG. 5, a plurality of discharge ports 22 are formed at a predetermined pitch on a discharge port surface 21 which faces the recording medium 8 with a predetermined gap (about 0.5 to 2 (mm)) therebetween. A common liquid chamber 23 to which the ink is supplied is in communication with each discharge port 22 via a corresponding channel 24. An electrothermal converter (heating resistor etc.) 25 for generating the thermal energy to discharge the ink is disposed along a wall surface of each channel 24. The recording head 1 is mounted on the carriage 2 so that the discharge ports 22 are lined up in the direction intersecting the scanning direction (direction of an arrow X) of the carriage 2. The electrothermal converter 25 is driven (energized) based on an image signal or a discharge signal to cause film boiling in the ink in the corresponding channel 24. The resulting pressure can then be used to discharge the ink droplets from the discharge ports 22.

Figure 6:
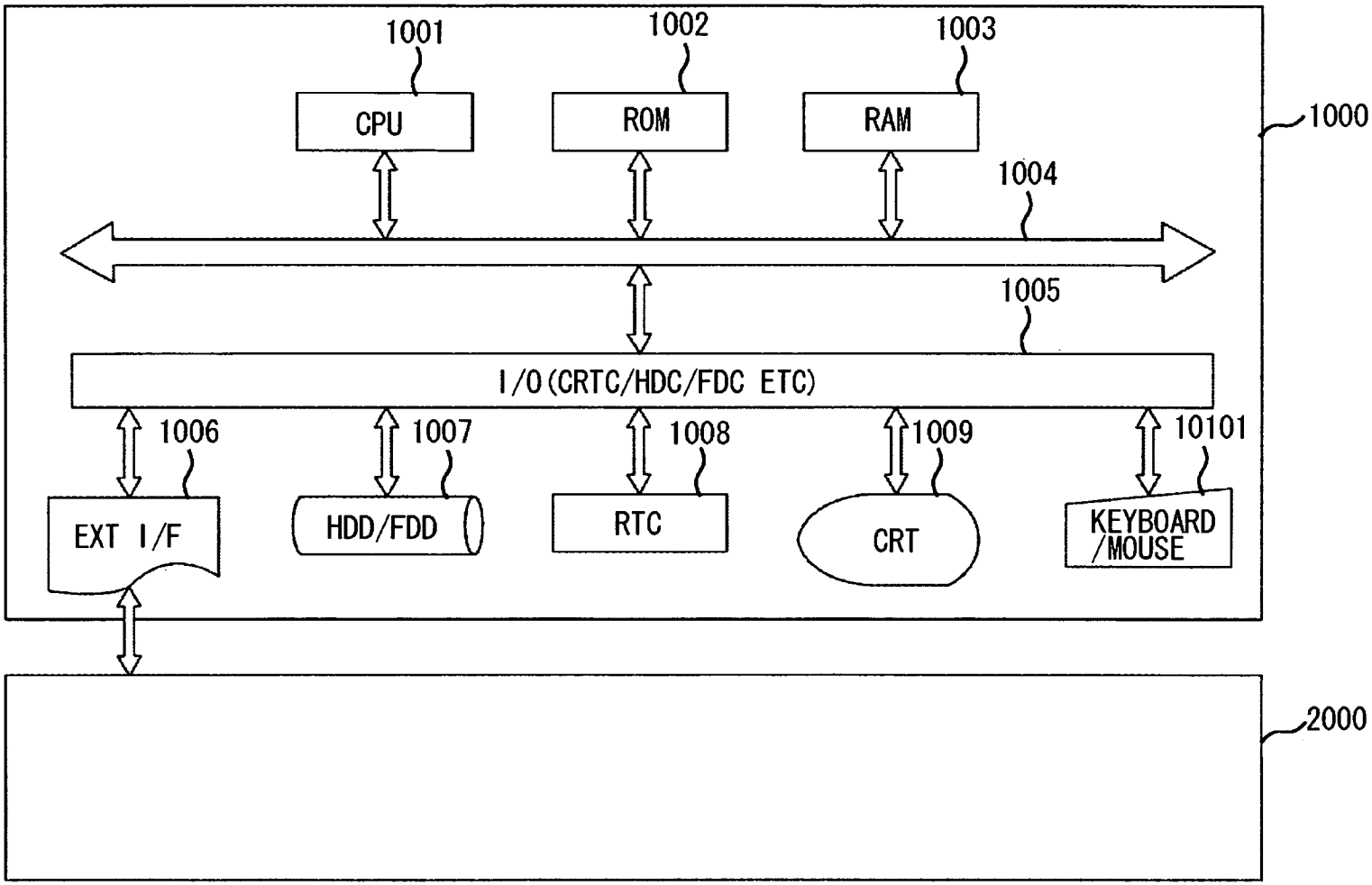
FIG. 6 is a configuration diagram illustrating a recording system according to the exemplary embodiment of the present invention.

FIG. 6 is a block diagram illustrating a hardware configuration of a recording system according to an exemplary embodiment of the present invention. The system according to the present exemplary embodiment is generally configured from a host apparatus 1000 which generates recording data, sets a user interface (UI) for generating the recording data and the like, and an inkjet recording apparatus 2000 which forms an image on the recording medium based on the recording data.

The host apparatus (host computer) 1000 includes a central processing unit (CPU) 1001, a read only memory (ROM) 1002, a random access memory (RAM) 1003, a system bus 1004, an input/output (I/O) controller 1005 (a cathode ray tube controller (CRTC), a hard disk controller (HDC), a floppy disk controller (FDC) or the like) for various I/O devices, an external interface (I/F) 1006, an external storage apparatus (HDD/FDD) 1007 such as a hard disk drive (HDD) and a floppy disk drive (FDD), a real time clock (RTC) 1008, a cathode ray tube (CRT) 1009, and an input apparatus (keyboard/mouse) 10101 such as a keyboard and a mouse.

The CPU 1001 operates based on an application program, a communication program, a printer driver, an operating system (OS) which are read from the external storage apparatus 1007 or the like into the RAM 1003. When power is turned on, the CPU 1001 is booted by the ROM 1002, and the OS is loaded from the external storage apparatus 1007 or the like into the RAM 1003. Then, an application program and driver software are similarly loaded to cause the system to function.

The external I/F 1006 sequentially transmits the recording data spooled in the RAM 1003 and the external storage apparatus 1007 (HDD) to the recording apparatus 2000. The input apparatus 10101 loads instruction data from a user into the host computer 1000 via the I/O controller 1005. The RTC 1008 clocks a system time, acquires and sets time information via the I/O controller 1005. The CRT 1009 is a display device controlled by the CRTC in the I/O controller 1005. A block of the CRT 1009 and the input apparatus 10101 constitute the user interface.

Figure 7:
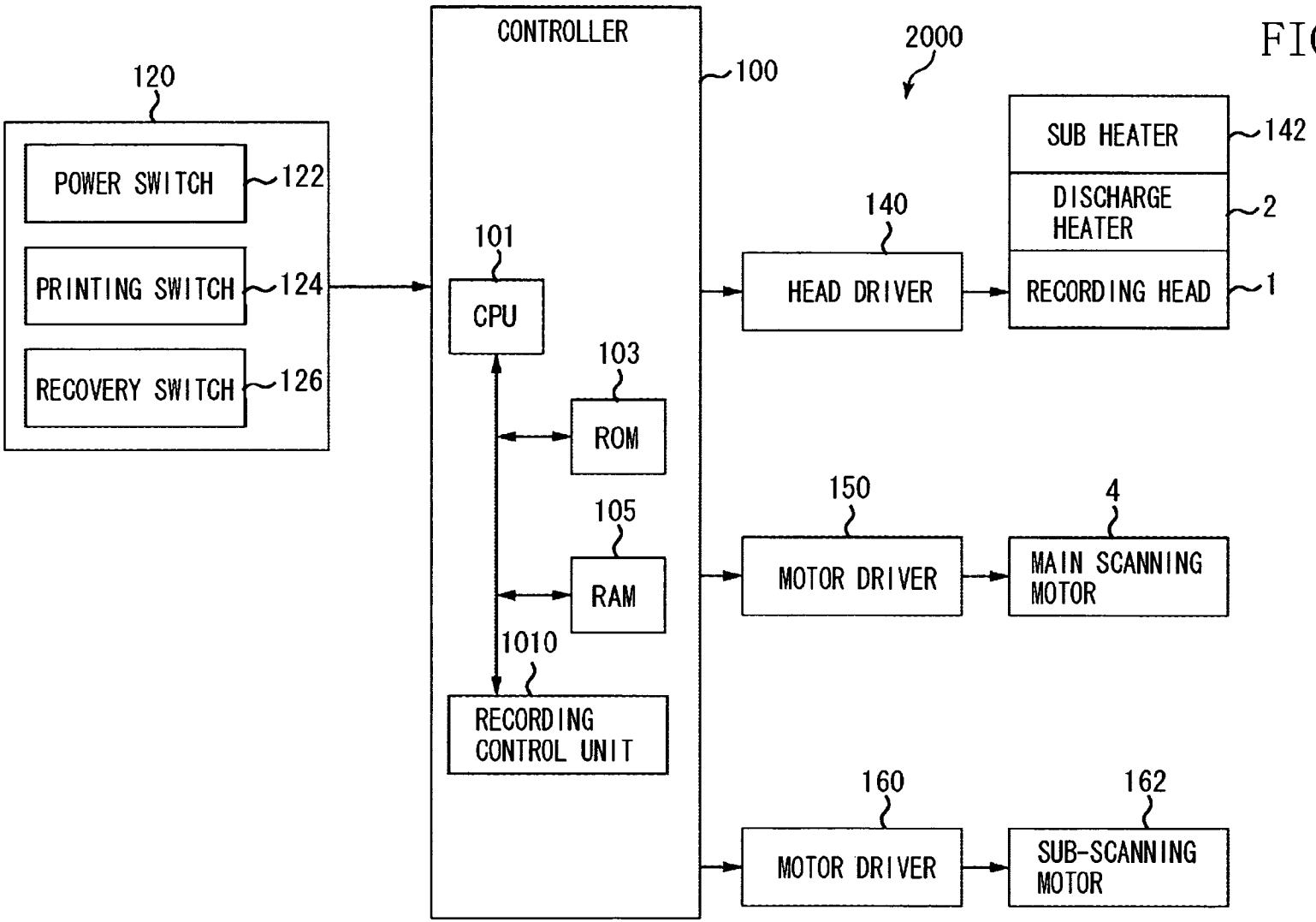
FIG. 7 is a block configuration diagram of a control system of the recording apparatus according to the exemplary embodiment of the present invention.

FIG. 7 is a block configuration diagram of a control system in the inkjet recording apparatus 2000 of FIG. 6.

In FIG. 7, a controller 100 is a main control unit which includes, for example, a CPU 101 (i.e., a microcomputer), a ROM 103 which stores programs, required tables, and other fixed data, a RAM 105 which includes a region for rasterizing the recording data and a work region, and a recording control unit 1010 illustrated in the below-described FIG. 13. The recording data, other commands, and status signals are sent and received between the host apparatus 1000 and the controller 100 via an interface (I/F) (not illustrated).

An operation unit 120 is a group of switches that receive an operator's instruction. The operation unit 120 includes a power switch 122, a printing switch 124 for instructing start of printing, and a recovery switch 126 for instructing activation of suction recovery. A head driver 140 drives the electrothermal converter (hereinafter, referred to as a "discharge heater") 25 in the recording head 1. The head driver 140 includes a shift register that aligns the recording data with a position of the discharge heater 25, a latch circuit that latches the recording data at an appropriate time, a logic circuit element that actuates the discharge heater 25 in synchronization with a driving timing signal, and a timing setting unit that appropriately sets a driving timing (discharge timing) to align ink dot formation positions.

In the present exemplary embodiment, the recording head 1 is provided with a sub heater 142 that adjusts temperature to stabilize discharge characteristics of the ink in the recording head 1. For example, the sub heater 142 may be formed on a substrate together with the discharge heater 25 or may be attached to the recording head main body or head cartridge.

A motor driver 150 drives the main scanning motor 4 that moves the carriage 2 in the main scanning direction. A motor driver 160 drives a sub-scanning motor 162 that conveys the recording medium 8 in the sub-scanning direction.

Figure 8:
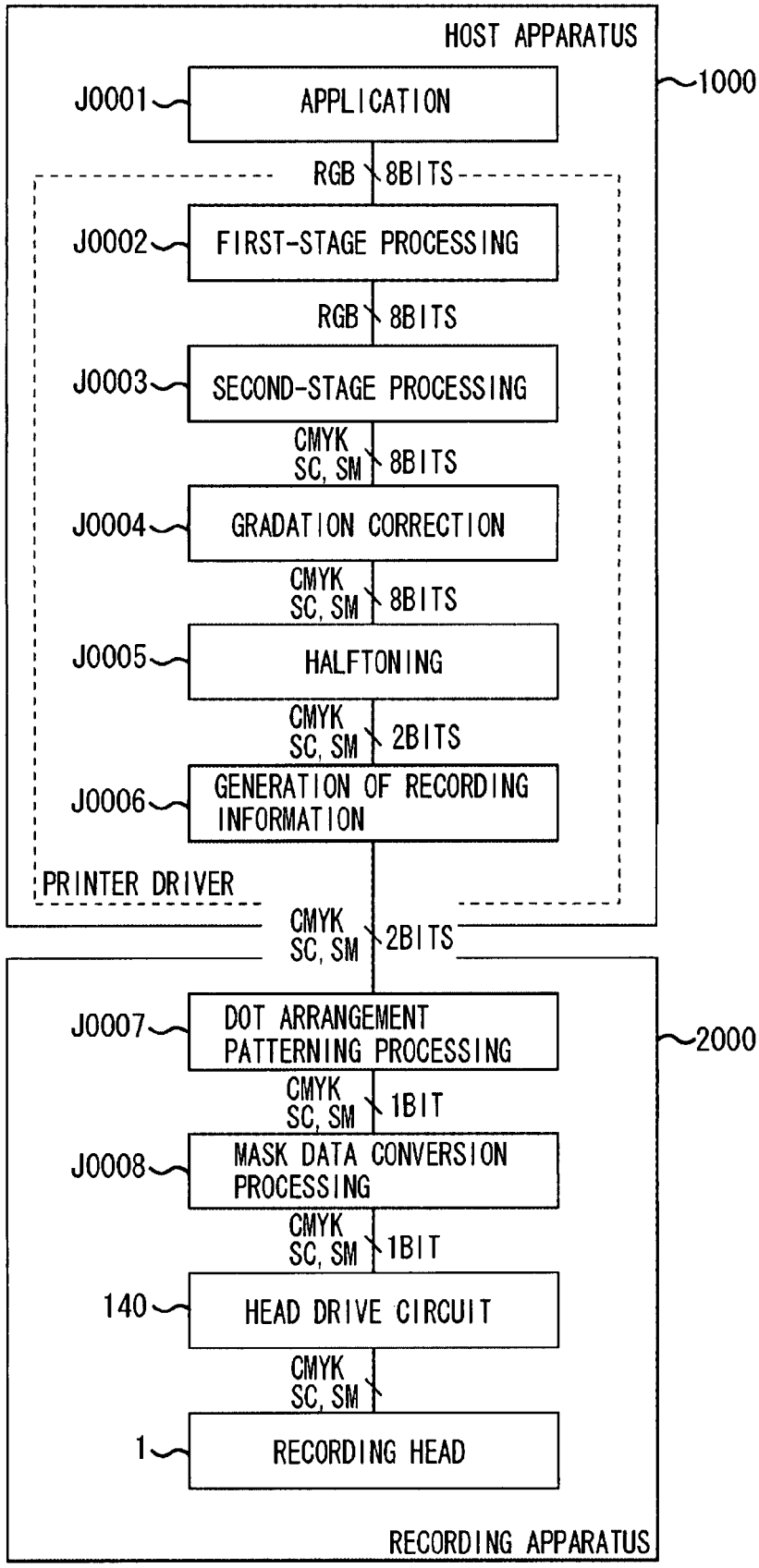
FIG. 8 is a block configuration diagram of an image processing system in the recording system according to the exemplary embodiment of the present invention.

FIG. 8 is a functional block diagram illustrating the recording system according to the present exemplary embodiment of the present invention along the flow of the recording data. As described above, the recording apparatus 2000 of the present exemplary embodiment records using four color inks, cyan, magenta, yellow, and black inks.

Programs operated by the operating system of the host apparatus 1000 include applications and a printer driver. An application J0001 executes generation processing of the data to be recorded by the recording apparatus 2000. The recording data and data not yet edited can be loaded into a personal computer (PC) type host apparatus 1000 via various media.

The PC type host apparatus 1000 in the present exemplary embodiment can load image data in, for example, a joint photographic experts group (JPEG) format captured by a digital camera via a compact flash (CF) card, a tag image file format (TIFF) format read by a scanner, and image data stored on a compact disc (CD) ROM. The host apparatus 1000 can further load data on the Web via the Internet. Such loaded data is displayed on a monitor of the host apparatus 1000 and then edited and processed via the application J0001. Thus, for example, recording data R, G, and B of the standard RGB (sRGB) is generated. The recording data is delivered to the printer driver based on a recording instruction.

The printer driver of the present exemplary embodiment includes processing units for first-stage processing J0002, second-stage processing J0003, gradation correction J0004, halftoning J0005, and recording data generation J0006. The first-stage processing J0002 maps a gamut.

The first-stage processing J0002 of the present exemplary embodiment uses a three-dimensional look-up table (LUT) in conjunction with an interpolation calculation to convert 8-bit image data R, G, and B into data R, G, and B in a gamut for the recording apparatus 2000. The three-dimensional LUT is a look-up table indicating a relationship that relates the gamut reproduced by the image data R, G, and B of the sRGB to a gamut reproduced by the recording apparatus 2000 of the recording system.

The second-stage processing J0003 obtains, based on the data R, G, and B mapped into the gamut by the first-stage processing J0002, separated data for each ink that reproduces the color expressed by the data. In the present exemplary embodiment, the second-stage processing J0003 obtains the separated data for each of the yellow, magenta, cyan, and black ink colors, and for the cyan and magenta ink colors, separated data in each dot size. More specifically, separated data Y, M, C, K, SC, and SM are obtained. As described below, the separated data Y, M, C, and K are for large dots formed by the yellow, magenta, cyan, and black ink, and the separated data SC and SM are for small dots formed by the cyan and magenta inks. As with the first-stage processing J0002, the second-stage processing J0003 of the present exemplary embodiment uses the three-dimensional LUT in conjunction with the interpolation calculation.

The gradation correction J0004 performs a gradation value conversion on each of the separated data for each ink color and for each dot size obtained by the second-stage processing J0003. More specifically, the gradation correction J0004 uses a one-dimensional LUT corresponding to gradation characteristics of each color ink used in the recording apparatus 2000 to convert the separated data corresponding to the ink color and dot size into data which is linearly associated with the gradation characteristics of the recording apparatus 2000.

The halftoning J0005 quantizes each piece of the 8-bit color separated data Y, M, C, K, SC, and SM, and converts the quantized data into 2-bit data. The present exemplary embodiment uses an error diffusion method to convert the 8-bit data into the 2-bit data. The 2-bit data is index data for indicating an arrangement pattern in below-described dot arrangement patterning processing performed by the recording apparatus 2000. The recording information generation processing J0006 adds recording control information to the recording data containing the 2-bit index data to generate recording information.

The above described processing of the application and printer driver is performed by the CPU 1001 (see FIG. 6) according to the programs for the application and printer driver. These programs are read from the ROM 1002 or the external storage apparatus 1007 such as a hard disk. The RAM 1003 is used as a work area in which the processing is executed based on the read programs.

Concerning the data processing, the recording apparatus 2000 performs dot arrangement patterning processing J0007 and mask data conversion processing J0008. The dot arrangement patterning processing J0007 arranges dots based on a dot arrangement pattern corresponding to 2-bit index data (gradation value information) as the recording data, for each pixel corresponding to an actual recording image. The dot arrangement pattern is assigned to each pixel expressed by the 2-bit data based on the gradation value of that pixel. As a result, it is defined whether a dot is on or off, namely whether to form a dot or not, for each of a plurality of areas in the pixel, so that discharge data "1" or "0" is placed in each area in each pixel.

The resulting 1-bit discharge data is subjected to mask processing by the mask data conversion processing J0008. Namely, discharge data is generated for each recording scan of the recording head 1. In multipass recording that completes image recording in a predetermined region by a plurality of scans of the recording head 1, discharge data for each scan is generated using a mask corresponding to each scan. The discharge data Y, M, C, K, SC, and SM for each scan are sent to the head driving circuit (head driver) 140 at suitable timing. The recording head 1 is thus driven based on the discharge data to discharge the ink.

The dot arrangement patterning processing J0007 and mask data conversion processing J0008 in the recording apparatus 2000 are executed using a dedicated hardware circuit under the control of the CPU 101 (see FIG. 7) constituting the control unit of the recording apparatus 2000. The processing may be executed by the CPU 101 based on a program or by, for example, the printer driver in the PC type host apparatus 100. As described below, the present invention is applicable regardless of forms of the processing.

The term "pixel" as used in the present specification refers to a minimum unit which can be expressed by gradation, and which is an object of the image processing (the above-described first-stage processing, second-stage processing, γ correction (gradation correction), and halftoning) of multi-valued data of a plurality of bits. In the halftoning processing, one pixel corresponds to a pattern composed of m×n (e.g., 2×2) frames. Each frame in one pixel is defined as an "area". The area is the minimum unit for which dot on or off is defined. In connection with this, the "image data" in the first-stage processing, second-stage processing, and γ correction refers to a group of pixels to be processed. In the present exemplary embodiment, each pixel corresponds to data containing an 8-bit gradation value. Further, the term "pixel data" in the halftoning corresponds to the image data itself to be processed. The halftoning of the present exemplary embodiment converts the pixel data containing the 8-bit gradation value into pixel data (index data) containing a 2-bit gradation value.

FIGS. 9, 10, 11A, and 11B illustrate a technique for controlling air current depending on the moving speed of the recording head 1. Four-pass recording in which the recording head 1 completes the image recording in the predetermined region on the recording medium by four scans is described as an example.

Figure 9:
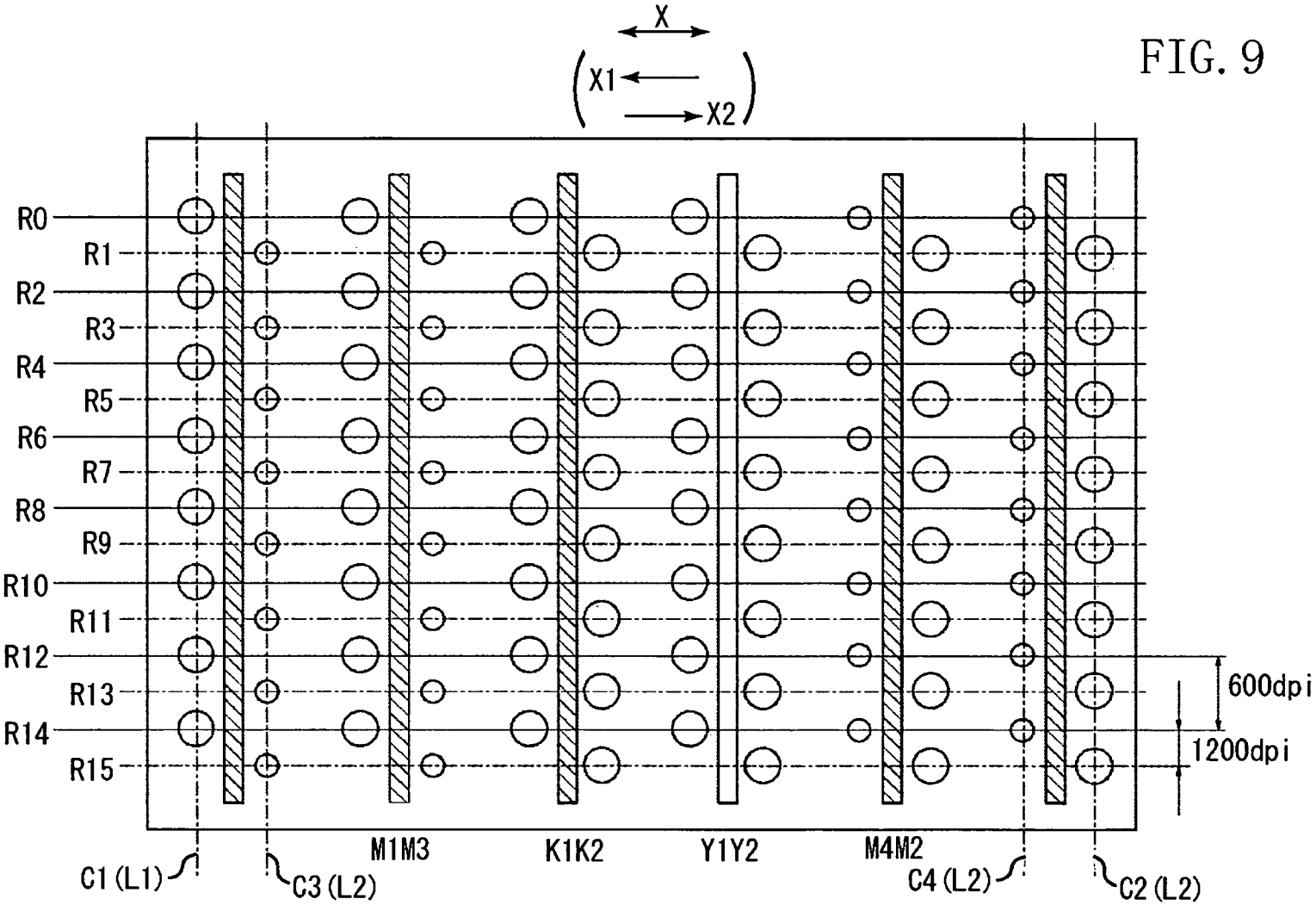
FIG. 9 illustrates a nozzle configuration of the recording head according to the exemplary embodiment of the present invention.

FIG. 9 illustrates the recording head used in the present exemplary embodiment. Nozzle arrays are formed in the recording head to discharge cyan (C), magenta (M), yellow (Y), and black (K) inks. The nozzle arrays for discharging cyan ink include nozzle arrays C1 and C2 for forming large dots and nozzle arrays C3 and C4 for forming small dots. These nozzle arrays are symmetrically formed in the main scanning direction. The nozzle arrays C1 and C3 are adjacent to each other across a common liquid chamber. The nozzle arrays C2 and C4 are also adjacent to each other across the common liquid chamber. Similarly, the nozzle arrays for discharging magenta ink include nozzle arrays M1 and M2 for forming large dots and nozzle arrays M3 and M4 for forming small dots. The nozzle arrays for discharging yellow ink include nozzle arrays Y1 and Y2 for forming large dots. Similarly, the nozzle arrays for discharging black ink include nozzle arrays K1 and K2 for forming large dots.

When such a recording head is used, a color image can be recorded by bidirectional recording in the main scanning direction illustrated by arrows X (X1 and X2). The arrow X1 is hereinafter referred to as a forward direction, and the arrow X2 as a backward direction. In the bidirectional recording, for example, the nozzle arrays C1, C3, M1, M3, K1, K2, Y1, and Y2 are used for forward recording, and the nozzle arrays C2, C4, M2, M4, K1, K2, Y1, and Y2 are used for backward recording. Thus, a discharge order of each ink during recording can be matched.

In the present exemplary embodiment, all nozzle arrays are used during the forward and backward recording, so that the recording speed can be increased. In the present embodiment, substantially equal recording data is allocated (distribution processing) to the pair of nozzle arrays (pair of large dot forming nozzle arrays or pair of small dot forming nozzle arrays) which discharges substantially equal amount of droplets of the same color ink so as not to allocate the recording data biased toward one side of the paired nozzle arrays. The paired nozzle arrays are thus equally used to uniformly distribute portions in different ink discharge orders.

By this configuration, occurrence of color unevenness can be suppressed and loads on the discharge heaters in the nozzles can be distributed. For example, large dot forming recording data for discharging a relatively large amount of cyan ink is rasterized to be distributed evenly to the nozzle arrays C1 and C2. Small dot forming recording data for discharging a relatively small amount of cyan ink is rasterized to be distributed evenly to the nozzle arrays C3 and C4.

In the present exemplary embodiment, the large dot forming nozzle array is referred to as a first nozzle array L1, and the small dot forming nozzle array is referred to as a second nozzle array L2. The larger the effect of the air current between the nozzles, the shorter the distance between the nozzle arrays. Accordingly, the air current exerts a larger effect between the nozzle arrays which are disposed across the common liquid chamber. Further, the effect of the air current is also larger on nozzle arrays which discharge a small amount of ink, namely nozzle arrays that discharge small ink droplets which have a lower kinetic energy. Moreover, the higher the moving speed of the recording head, the larger the effect of the air current.

Figure 10:
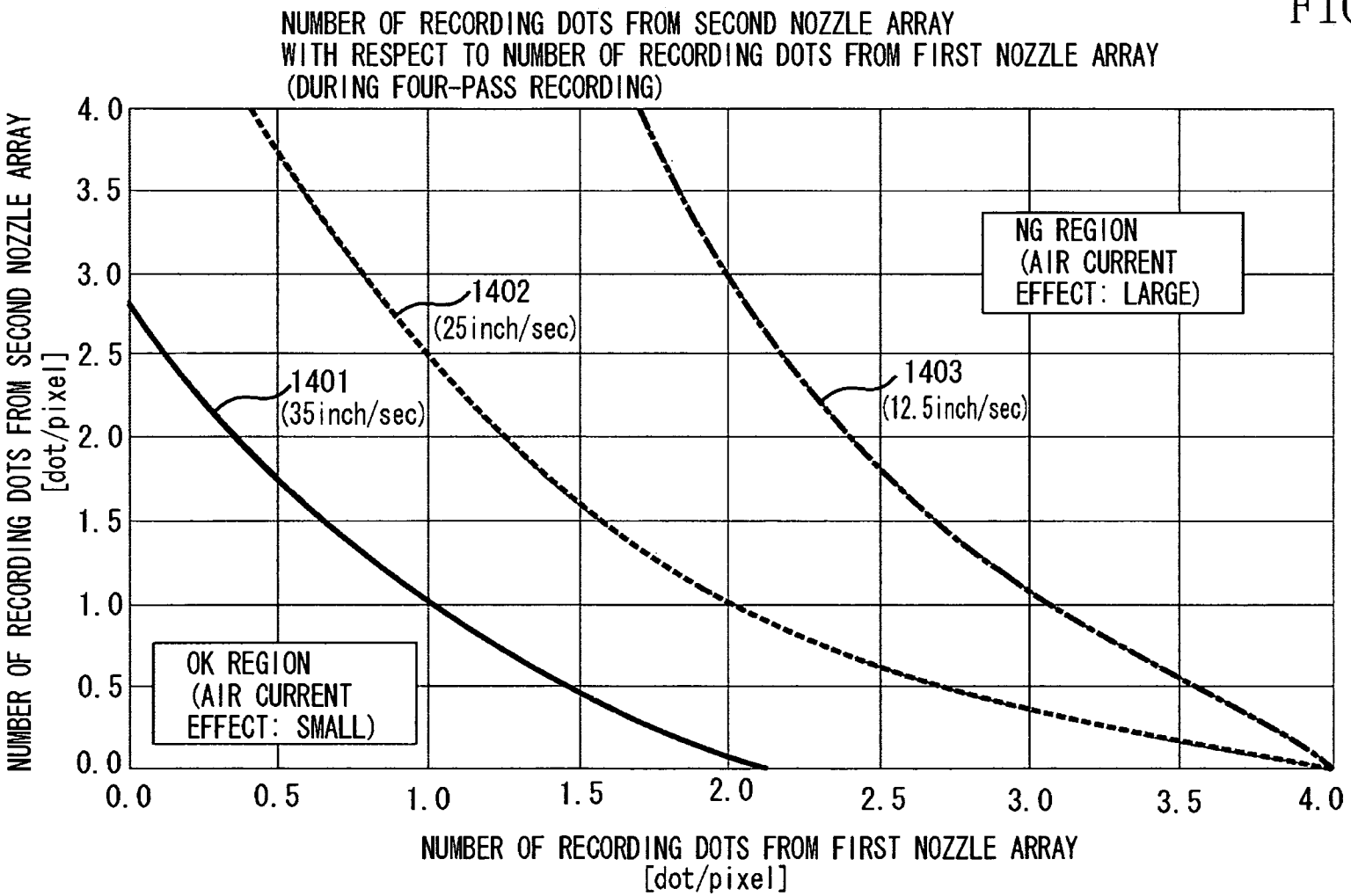
FIG. 10 illustrates air current control lines according to the exemplary embodiment of the present invention.

As illustrated in FIG. 10, in the present exemplary embodiment, air current control lines 1401, 1402, and 1403 for suppressing the effect of the air current between the first nozzle array L1 and the second nozzle array L2 were experimentally obtained for cases where the moving speed of the recording head are different in the four-pass recording.

Figure 11B:
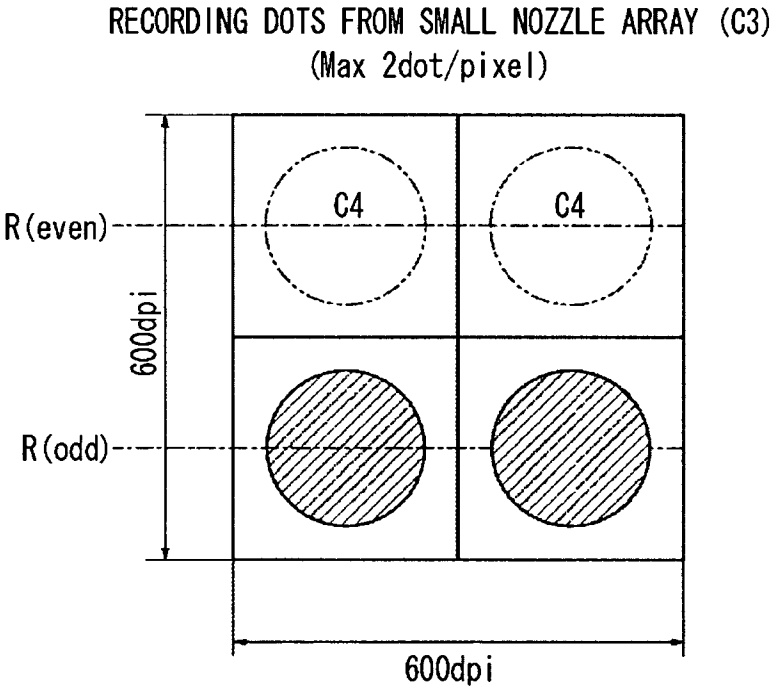
FIGS. 11A and 11B illustrate dot patterns formed by large and small nozzle arrays according to the exemplary embodiment of the present invention.
Figure 11A:
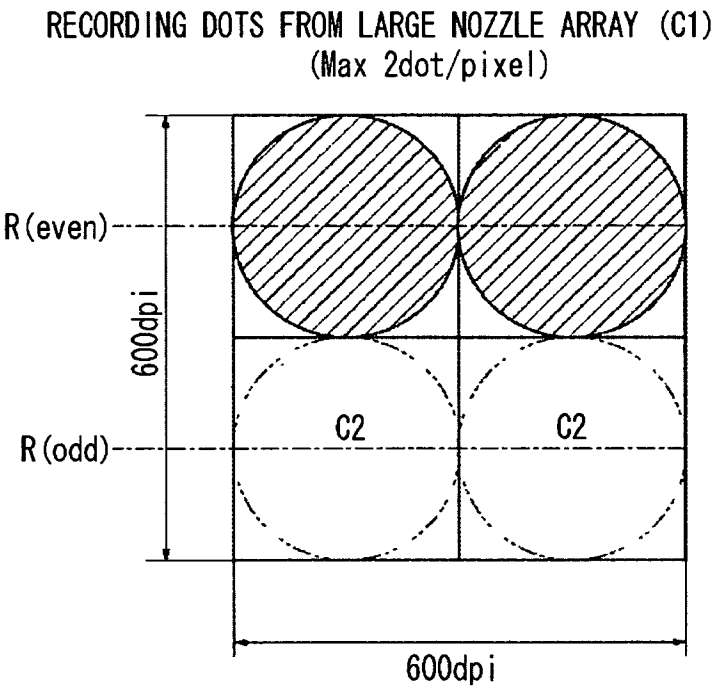

In FIG. 10, vertical and horizontal axes represent a number of dots formed per pixel. As illustrated in FIG. 9, for each ink color, one large dot forming nozzle is located on the same raster (R0 to R15), and one small dot forming nozzle is similarly located on the same raster (R0 to R15). Thus, for example, a maximum number of large dots formed within one pixel by the nozzle array C1 is two on an even-numbered raster as illustrated in FIG. 11A, and a maximum number of small dots formed within one pixel by the nozzle array C3 is two on an odd-numbered raster as illustrated in FIG. 11B.

Accordingly, for the cyan ink discharging nozzle arrays, the horizontal axis in FIG. 10 represents the total number (maximum number: 4) of dots formed within one pixel by the nozzle arrays C1 and C2 as the first nozzle array L1.

Further, the vertical axis in FIG. 10 represents the total number (maximum number: 4) of dots formed within one pixel by the nozzle arrays C3 and C4 as the second nozzle array L2. The large dot forming recording data is evenly allocated to the nozzle arrays C1 and C2, and the small dot forming recording data is evenly allocated to the nozzle arrays C3 and C4.

Thus, the air current control lines 1401, 1402, and 1403 represent a ratio between the number of dots formed within each pixel by the first nozzle array and the number of dots formed within each pixel by the second nozzle array.

First, based on the air current control line 1401, the number of dots formed per pixel by the first and second nozzle arrays will be considered. A region above the air current control line 1401 is an NG region in which the effect of the air current due to the ink discharge is large, so that recording of high quality images is difficult. On the other hand, a region in which the total number of dots formed by the first and second nozzle arrays is fewer, namely a region below the air current control line 1401 is an OK region in which the effect of the air current due to the ink discharge is small, so that recording of high quality images is possible. When controlling the recording, the recording must be performed based on the recording data which sets the number of dots formed by the first and second nozzle arrays at a value within the OK region.

The three air current control lines 1401, 1402, and 1403 represent different recording head moving speeds in four-pass recording. When the recording head moves at a speed of 35 [inches/second], recording data is generated so that dots are formed within the OK region of the air current control line 1401. An image is then recorded based on the generated recording data. When the recording head moves at a speed of 25 [inches/second], recording data is generated so that dots are formed within the OK region of the air current control line 1402. An image is then recorded based on the generated recording data. When the recording head moves at a speed of 12.5 [inches/second], recording data is generated so that dots are formed within the OK region of the air current control line 1403. An image is then recorded based on the generated recording data.

The smaller the effect of the air current, the slower the recording head speed. Accordingly, the air current control line is drawn at a higher position as the moving speed becomes slower, and the OK region broadens. Thus, the recording data is generated so that dots are formed within the OK region corresponding to the moving speed of the recording head. An image is then recorded based on the generated recording data. Accordingly, recording control can be realized without being affected by the air current, regardless of the moving speed of the recording head.

Figure 12:
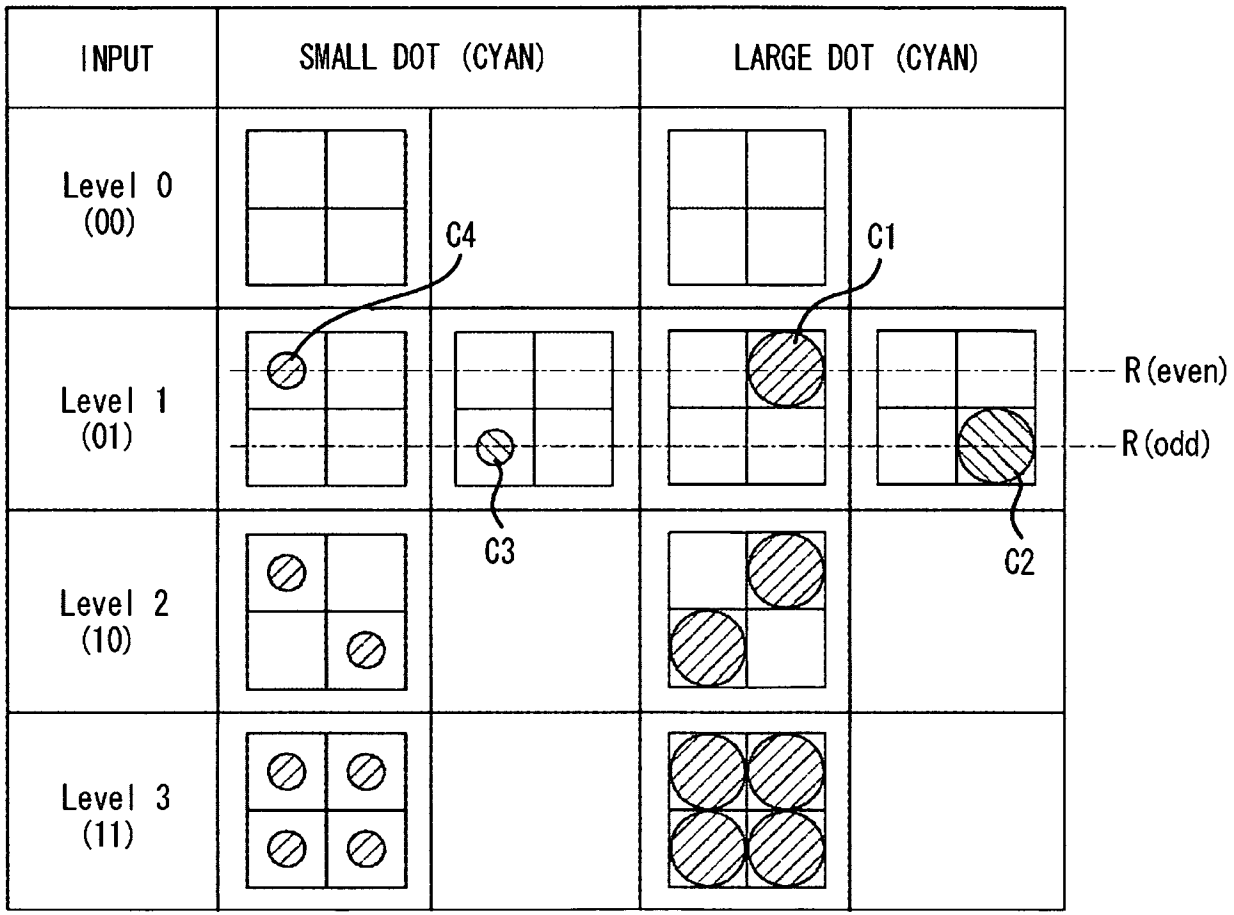
FIG. 12 illustrates a format of the recording data according to the exemplary embodiment of the present invention.

FIG. 12 illustrates a configuration example of large and small dot forming recording data. Each of these pieces of data has an independent 2-bit data format. When the large dot forming recording data is at a level 1, one large dot is formed in one pixel. Similarly, when the small dot forming recording data is at a level 1, one small dot is formed in one pixel. In this case, the former level 1 recording data is evenly distributed to the pair of large dot forming nozzle arrays (for example, the nozzle arrays C1 and C2 for the cyan ink). The latter level 1 recording data are evenly distributed to the pair of small dot forming nozzle arrays (for example, the nozzle arrays C3 and C4 for the cyan ink).

Figure 13:
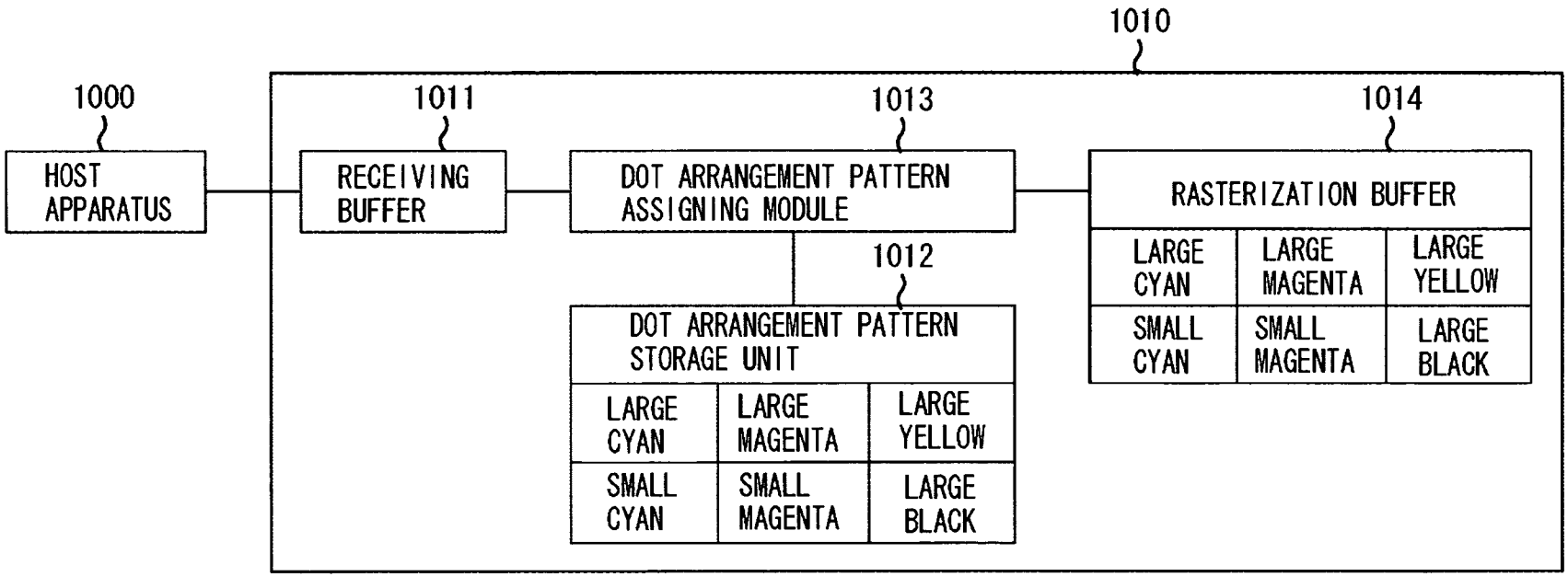
FIG. 13 is a block configuration diagram of a recording control unit according to the exemplary embodiment of the present invention.

FIG. 13 is a block configuration diagram illustrating distribution processing of the recording data.

In the recording control unit 1010 of the inkjet recording apparatus 2000, a receiving buffer 1011 receives 2-bit quantized recording data from the host apparatus 1000. A dot arrangement pattern storage unit 1012 stores dot arrangement patterns. A dot arrangement pattern assigning module 1013 executes the dot arrangement patterning processing of FIG. 8. The dot arrangement pattern assigning module 1013 assigns a dot arrangement pattern stored in the storage unit 1012 to the recording data in the receiving buffer 1011.

A rasterization buffer (recording buffer) 1014 rasterizes the recording data based on the dot assignment pattern assigned by the dot arrangement pattern assigning module 1013. The dot arrangement pattern assigning module 1013 is a software module stored in the ROM 103 (see FIG. 7) and executed by the CPU 101 (see FIG. 7). The receiving buffer 1011, storage unit 1012, and rasterization buffer 1014 are provided in a predetermined address region in a dynamic RAM (DRAM).

Pre-numbered dot arrangement patterns are stored in the dot arrangement pattern storage unit 1012. As illustrated in FIG. 12, the dot arrangement patterns can be composed of recording data (quantized data at levels 0 to 3) for each of dots with a different size. A pattern selected from among these dot arrangement patterns is rasterized in the rasterization buffer 1014. Dots are then formed based on the rasterized pattern.

In FIG. 13, large cyan is a pattern for forming a large dot of the cyan ink, and small cyan is a pattern for forming a small dot of the cyan ink. Large magenta is a pattern for forming a large dot of the magenta ink, and small magenta is a pattern for forming a small dot of the magenta ink. Large yellow is a pattern for forming a large dot of the yellow ink, and large black is a pattern for forming a large dot of the black ink.

Figure 14:
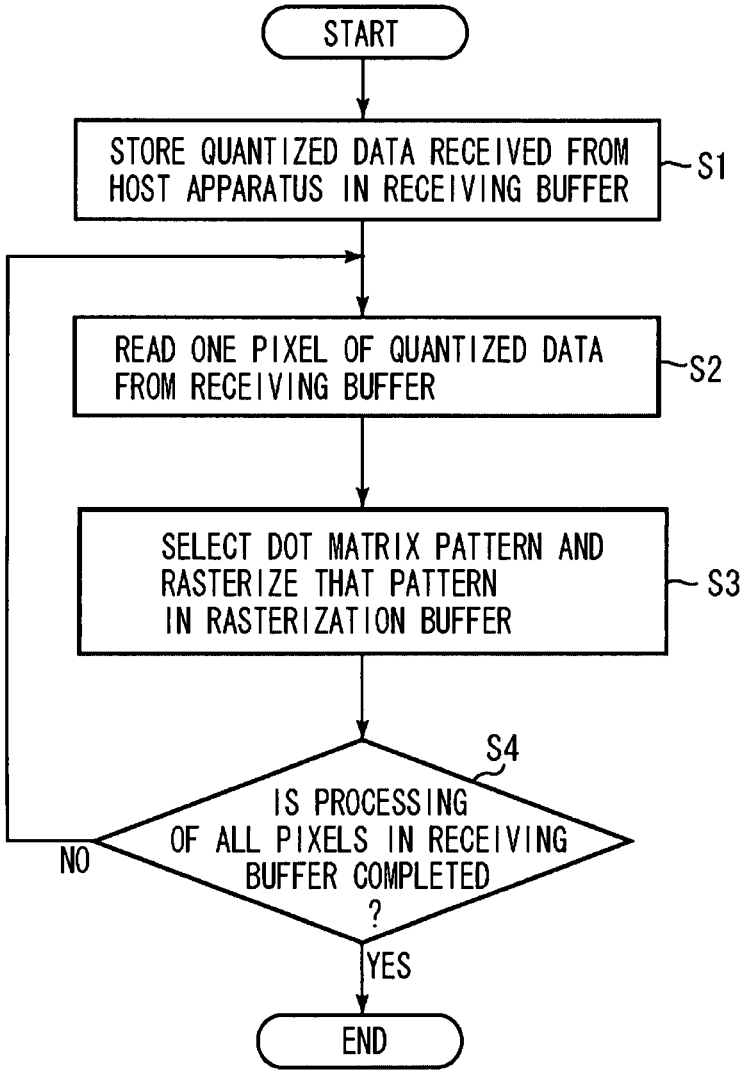
FIG. 14 is a flowchart illustrating data rasterization processing according to the exemplary embodiment of the present invention.

FIG. 14 is a flowchart illustrating the data rasterization processing performed by the dot arrangement pattern assigning module 1013.

First, in step S1, the recording data (2-bit quantized data) transferred from the host apparatus 1000 is received and stored in the receiving buffer 1011. Then, in step S2, recording data corresponding to one pixel is read from the stored recording data. In step S3, a dot arrangement pattern corresponding to the level (0 to 3) of the read recording data is selected and rasterized in the rasterization buffer 1014. If two dot arrangement patterns are available for recording data having the same level, one of the dot arrangement patterns is selected and rasterized. At that stage, the two dot arrangement patterns having the same level are alternately assigned.

In the present exemplary embodiment, when small dots of the cyan ink are to be formed using the level 1 recording data, two patterns such as those illustrated in FIG. 12 are alternately assigned so that the recording data is evenly distributed to the nozzle arrays C3 and C4. Then, in step S4, the CPU determines whether all the pixels in the recording data stored in the receiving buffer 1011 have been rasterized in the rasterization buffer 1014. If not all the pixels have been rasterized (NO in step S4), the processing returns to step S2. If all the pixels have been rasterized (YES in step S4), the CPU finishes the data rasterization processing.

Figure 15A:
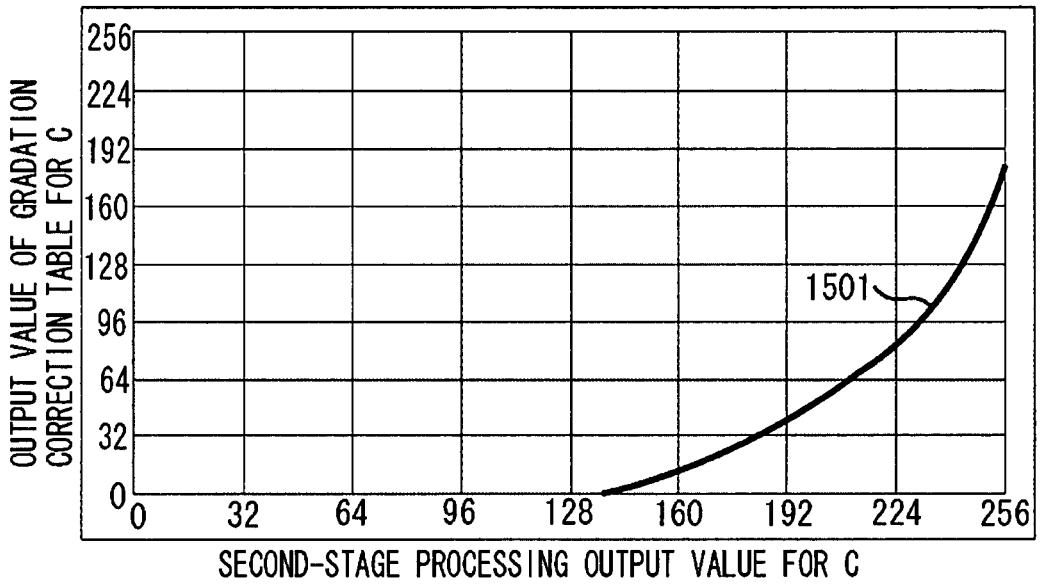
FIGS. 15A and 15B illustrate gradation correction processing according to the exemplary embodiment of the present invention.
Figure 15B:
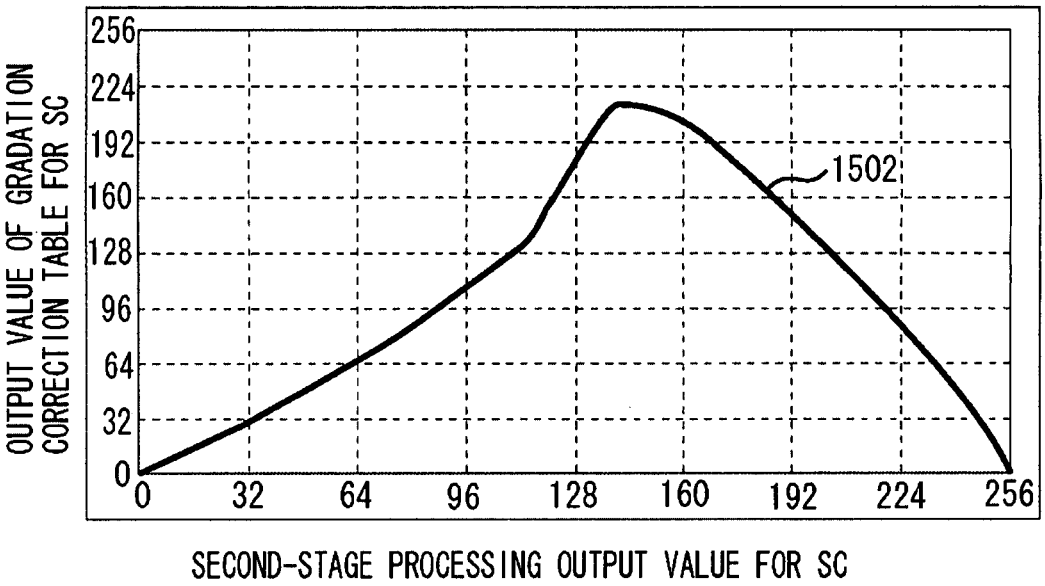

FIGS. 15A and 15B are diagrams specifically illustrating a method for generating recording data corresponding to the large and small dot forming nozzle arrays as illustrated in FIG. 9.

In the present exemplary embodiment, recording data within the OK region of the air current control line is generated for each gradation level of a recording image while maintaining the gradation characteristics. In this example, recording data as illustrated in FIGS. 15A and 15B corresponding to each nozzle array is finally generated via a series of data processing including the data conversion processing of the gradation correction J0004 (see FIG. 8). As described above, in the gradation correction J0004, the one-dimensional LUT corresponding to the gradation characteristics of each color ink is used to convert the color separated data of each of the 8-bit C, M, Y, K, SC, and SM colors (second-stage processing output data) into separated data corresponding to the ink colors and dot sizes, which is then delivered to the quantization processing.

FIGS. 15A and 15B are diagrams representatively illustrating a method for generating a C gradation correction table for large dot formation for the cyan ink and an SC gradation correction table for small dot formation for the cyan ink. These large and small dots of the cyan ink are formed using nozzle arrays which are adjacent to each other (in FIG. 9, nozzle arrays C1 (L1) and C3 (L2) or C2 (L1) and C4 (L2)).

In FIGS. 15A and 15B, horizontal axes represent the second-stage processing output data of each plane which has color separation. The separation has been performed in a range from 0, at which C and SC data are not recorded, to a cyan signal value of 255, which has the highest density.

On the other hand, the vertical axes in FIGS. 15A and 15B represent values of the 8-bit gradation correction processing output data C' and SC'. Namely, the vertical axes represent the gradation correction table format. Further, how the data is converted in the second-stage processing J0003 depends on the moving speed of the recording head. In FIGS. 15A and 15B, in order that a relationship between S and SC in the gradation correction table can be easily understood, an example is used in which the moving speed of the recording head is 35 [inches/second]. However, similar gradation correction tables are prepared for other moving speeds of the recording head.

FIG. 15A illustrates C data gradation correction processing, and FIG. 15B illustrates SC data gradation correction processing. As illustrated in FIG. 15A, the second-stage processing output signal values from 0 to 255 vary as shown in a curve 1501. The curve 1501 has a C data correction output value of 0 in the region where the second-stage processing output signal value is from 0 to 144. Further, in the region from 144 to 255, the correction output value steadily increases. At the second-stage processing output signal value of 255, the gradation correction processing is performed so that the correction output value is 175.

On the other hand, in FIG. 15B, the second-stage processing output signal values from 0 to 255 vary as shown in a curve 1502. In the curve 1502, a SC data correction output value steadily increases in the region where the second-stage processing output signal value is from 0 to 144, reaches a maximum value of 213 when the second-stage processing output signal value is 144, and then steadily decreases in the region of from 144 to 255. At the second-stage processing signal value of 255, the gradation correction processing is performed so that the correction output value is 0. The input value of 144 at the point where the curves 1501 and 1502 of FIGS. 15A and 15B change is an experimentally-determined threshold. The threshold value changes depending on the distance between the recording head nozzle arrays, the number of nozzles in the nozzle arrays, and the moving speed of the recording head.

The 3D LUT table used in the second-stage processing J0003 is generated so that C and SC always have the same value. Further, the interpolation calculation is also similarly performed with the S and SC values. More specifically, the second-stage processing output signal value, which is an input signal to the gradation correction J0004, is processed so that C and SC have exactly the same values. The corrected signal values for C and SC in the gradation correction J0004 are quantized to the level 4 in the halftoning J0005. Further, the final number of recording dots for each of levels 0 to 4 is determined by a pattern such as that illustrated in FIG. 12 by the dot arrangement patterning processing J0007.

Figure 16A:
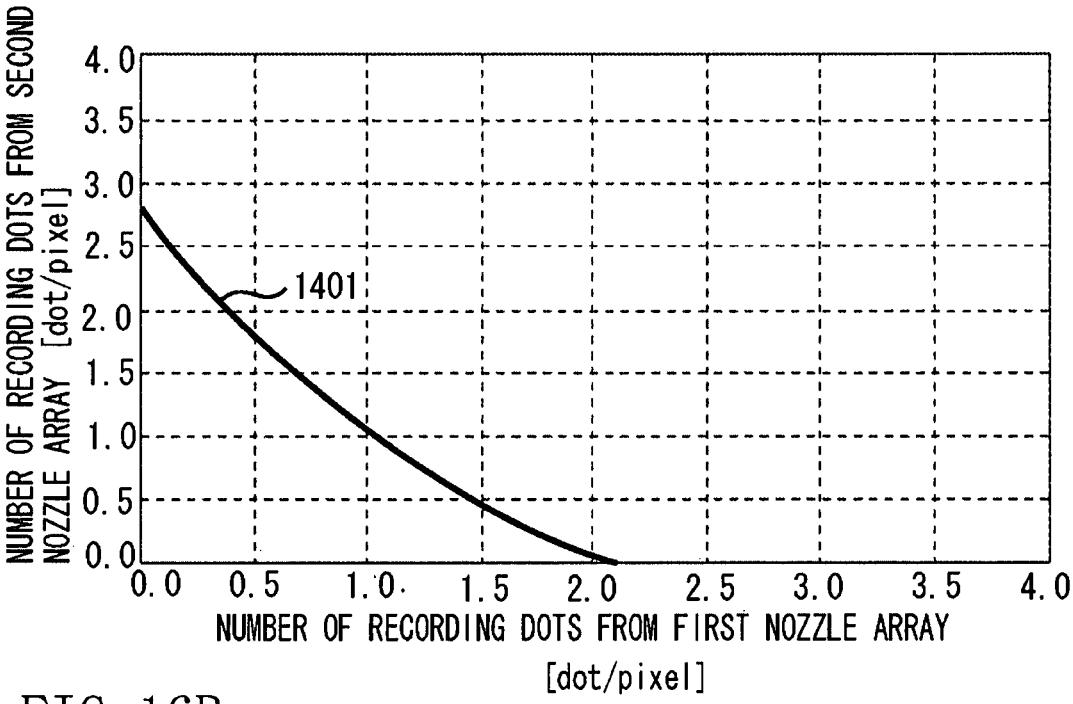
FIGS. 16A and 16B illustrate transition in a number of large and small recording dots according to the exemplary embodiment of the present invention.
Figure 16B:
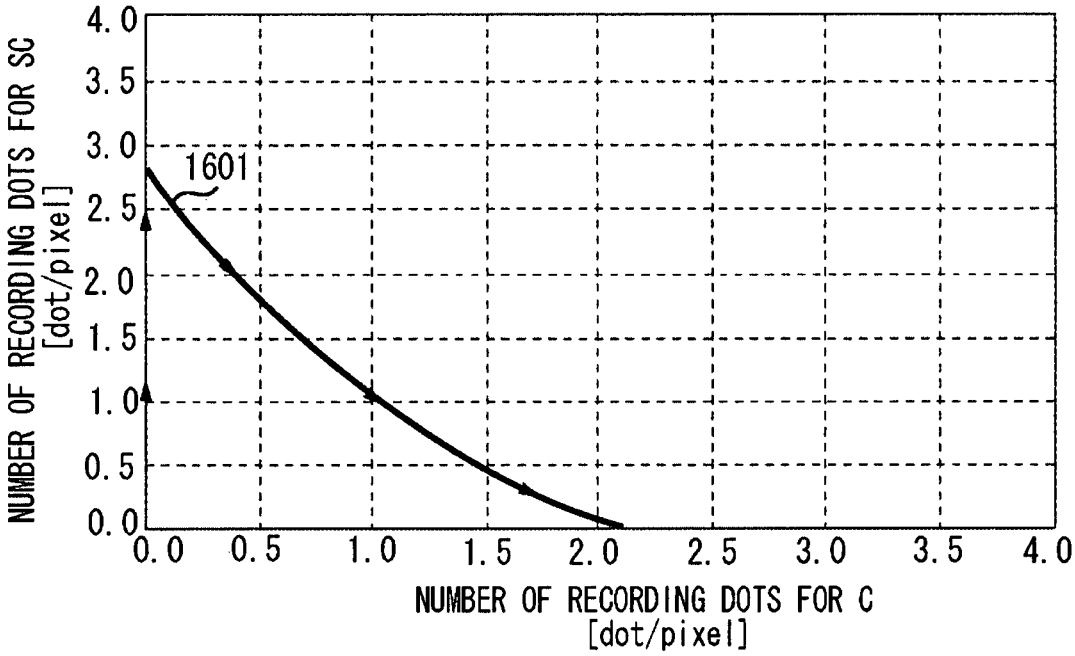

FIG. 16A is a diagram illustrating only the air current control line 1401 of FIG. 10. FIG. 16B is a diagram illustrating transition in the number of large and small recording dots on a curve 1601. The curve 1601 is obtained in the following manner. First, when the output signal value from the second-stage processing J0003 varies from 0 to 255, the gradation correction J0004 is performed using the gradation correction tables illustrated in FIGS. 15A and 15B. Next, the halftoning J0005 and the dot arrangement patterning processing J0007 are performed.

As a result of the series of processing, transition in the number of finally-obtained large and small recording dots is illustrated as the curve 1601. For ease of understanding, a direction of the transition in the number of large and small recording dots when the output signal value of the second-stage processing increases from 0 to 255 is illustrated with arrows in FIG. 16B.

A relationship between the gradation correction table and the actual recording dots will be described using FIGS. 15A, 15B, and 16B. In FIG. 16B, the number of small dots increases along the vertical axis from the origin to the curve 1601. This corresponds to the characteristics that the C correction value is 0 until the input value of 144 on the curve 1501 of FIG. 15A, and only the curve 1502 of FIG. 15B is steadily increasing. At the second-stage output signal value of 144, the curve 1502 has a maximum value of 213 and the curve 1501 is 0. This corresponds to a point of reverse of the number of small dots on the vertical axis with a maximum value of 2.8 on the curve 1601.

Subsequently, the curve 1601 indicates that the number of small dots decreases with the increase in the number of large dots. In this region, the curves 1501 and 1502 are formed so that the curve 1601 has exactly the same characteristics as the air current control line 1401 of FIG. 16A. More specifically, in FIGS. 15A and 15B, for the same input signal value (=the second-stage signal output value), with a boundary at the input value of 144, the curve 1501 is formed to steadily increase, and curve the 1502 is formed to decrease according to the amount of steady increase in curve 1501.

According to these curves 1501 and 1502, the number of large and small recording dots corresponds one-to-one with each other. Further, since the halftoning J0005 and the dot arrangement patterning processing J0007 are performed, shapes of the curves 1501 and 1502 can be determined such that the transition occurs on the air current control line 1401 of FIG. 16A. The curve 1601 in FIG. 16B finishes at a point on the horizontal axis, in other words, where the number of large recording dots is 2.1 and the number of small recording dots is 0. This corresponds to the C and SC correction output values of 175 and 0 when the second-stage output signal value in FIGS. 15A and 15B is 255.

It can be seen that the conditions are controlled by the second-stage processing J0003 and the gradation correction J0004. However, the second-stage processing J0003 merely equalizes the input signal values input to the gradation correction J0004 and forms a one-to-one relationship between C and SC. It can thus be seen that what actually realizes the air current control conditions is the one-dimensional LUT used in the gradation correction J0004. Namely, no restrictions exist between the interpolation algorithm in the second-stage processing J0003 and the air current control line. Therefore, there is no longer any need to consider a discrepancy between the interpolation algorithm and the air current limitation conditions which is generated when the air current control is realized by a conventional second-stage processing unit.

Further, in the present exemplary embodiment, the air current conditions are realized by the gradation correction table. Since control is performed by a pre-quantized signal value, the average number of dots in a certain macro-region can be controlled. More specifically, a control limitation by integer dot units which is generated by the index pattern is eliminated and a degree of freedom in image formation dramatically increases.

Next, effects of the present exemplary embodiment will be described. In the present exemplary embodiment, recording data is generated as described above while considering the effect of air current, impact precision of small droplets, and the grainy effect of the recording image when starting to form the large dots. Further, the present exemplary embodiment is implemented in the following manner in order to set the conditions so that deterioration in the image quality caused by the effect of the air current which is generated by the ink discharge between the nozzle arrays is within an acceptable range. More specifically, when the separated data for each ink is obtained, the output values of the separated data corresponding to large and small dots in the same color are made the same, and gradation correction is performed on the separated data of large and small dots having the same value.

By setting the conditions at a stage of data prior to quantization, a larger-scale adjustment can be performed as compared with setting the conditions to eliminate the effect of the air current after quantization. Thus, an image with good quality and few grainy effects can be formed within the air current control region and on the air current control line which allows use of many small dots as possible.

Further, since the effect of the air current is adjusted for data after ink color separation, the present exemplary embodiment can be realized by a simple method of converting the input/output characteristics using the one-dimensional LUT. Considering time required to produce the three-dimensional LUT coupled with air current adjustment which is needed when air current adjustment is performed before the ink color separation, this is a much simpler technique.

According to the conventional technique, an optimum image cannot be obtained due to a limitation in the control with integer dot units which is generated when air current control is realized by the index pattern. However, according to the present exemplary embodiment, this problem does not occur. Moreover, the conventional technique has problems such as the discrepancy between the interpolation algorithm and the air current limitation conditions which is generated when the air current control is realized by the second-stage processing unit, deterioration in image quality due to air currents, and complex design work. However, these problems do not occur in the present exemplary embodiment. According to the present exemplary embodiment, an optimum image can be formed while realizing the air current control.

The characteristics of the gradation correction tables used in the above exemplary embodiment will be described. As described concerning FIGS. 15A and 15B, the gradation correction tables are generated so that the amount of ink which is applied by the recording head satisfies the air current conditions by the respective gradation correction table with respect to C and SC. C and SC are set so that both colors have the same signal values outputted in the second-stage processing.

Figure 17:
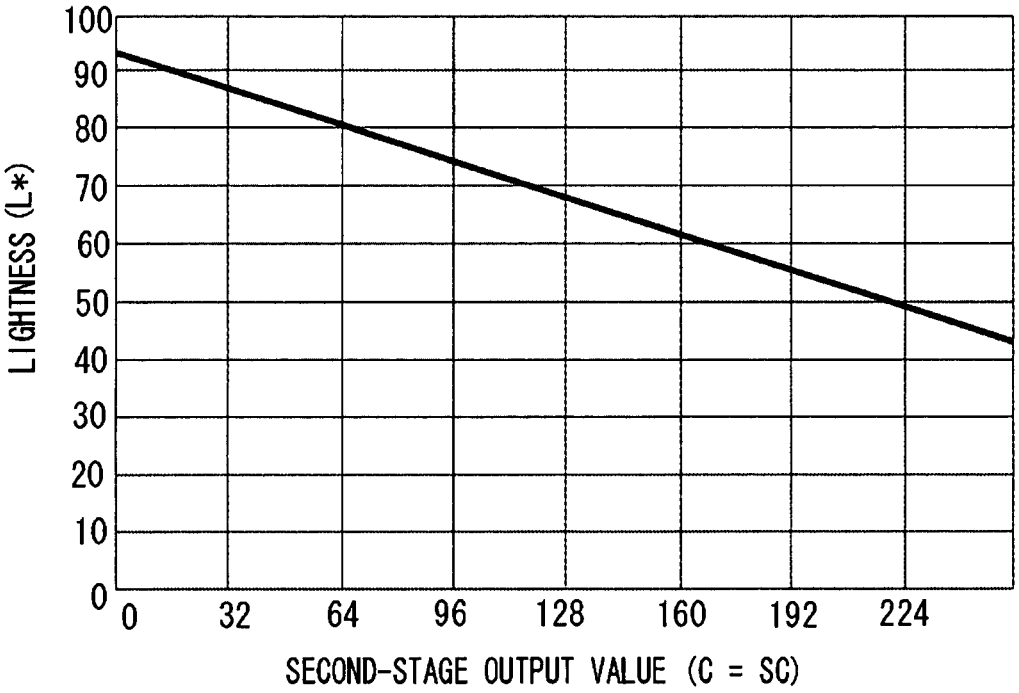
FIG. 17 illustrates an optical property for second-stage output values of monochrome C ink according to the exemplary embodiment of the present invention.

FIG. 17 is a graph illustrating the optical characteristics that appears when only inks which are the same color in terms of second-stage output signal values (e.g., the two colors C and SC) are subjected to gradation correction using the gradation correction tables illustrated in FIGS. 15A and 15B, and the resulting data is printed out. The horizontal axis of the graph illustrated in FIG. 17 represents output signal values for C and SC in the second-stage processing, and the vertical axis represents lightness (L*). As described above, the output signal values for C and SC in the second-stage processing are set to be the same. Here, L* is the lightness specified by Commission Internationale d'Eclairage (CIE L*a*b*).

As can be seen from the graph, the optical characteristics of the printed output using two color inks with the same color (e.g., the two colors C and SC) are set to show linear characteristics for the output signal values in the second-stage processing. Therefore, when the color separation is performed in the second-stage processing, the optical linearity of the output signal values of the color separation table can be assured.

As described above, during color separation, it is common to set only the grid points as values on the table and values between grid points are calculated using a linear interpolation calculation, such as tetrahedral interpolation. Since there is optical linearity such as illustrated in FIG. 17 for the second-stage values calculated by the interpolation calculation, optical linearity can be assured also for the results of the interpolation calculation. Even if the air current limitation conditions are satisfied, the relationship between C and SC loses its optical linearity for the results of the interpolation calculation in the color separation if the gradation correction table lacks optical linearity. As a result, image defects such as pseudo-contours occur in the printed output.

As illustrated in FIG. 17, a good-quality image which is free from image defects can be formed when the C and SC gradation correction table has the optical linearity for the second-stage signal values. For the sake of convenience, the optical characteristics are described using lightness as an example. However, the optical characteristics are not limited thereto. Other than lightness, optical characteristics such as color saturation, color difference, density, luminance and the like can be selected as depending on designing when applying the present invention. The present invention is directed to forming a gradation correction table in which linearity for all of these optical characteristics is maintained for the second-stage output values.

In the block configuration diagram of the image processing system of FIG. 8, the bit number of the input signal value and the output signal value for the gradation correction J0004 are common for all colors, and are both represented by 8-bits. The gradation characteristics can be further improved by increasing the bit number of the input value for the gradation correction J0004 relating to C and SC which are subject to the air current limitation conditions, to a larger number than 8 bits.

If there is no air current limitation condition, the output value is set to be associated with the 256 stages (0 to 255) of the second-stage input signal values. On the other hand, as illustrated in FIG. 15A, when Cis subject to the air current limitation conditions (the curve 1501), the C data correction output value is 0 in the region of 0 to 144 for the output signal value in the second-stage processing. In the region from 144 to 255, the correction output value is steadily increasing. Namely, the second-stage output value associates the output value with 111 stages.

The actual input stage for the dots decreases in the above-described case where there is no air current limitation, and the change in the output value for one stage of the second-stage signal values also increases. This may become a factor that reduces smoothness of the gradation reproduction when the current image outputs continuous gradations.

Therefore, by making the input values finer in the gradation correction J0004 of FIG. 8, smoother values are output from the gradation correction table, so that an image with good gradation reproduction during continuous gradations can be realized. Here, making the input values finer in the gradation correction J0004 of FIG. 8 means allowing decimal fractions to be used in the second-stage output values. Generally, decimal calculations have a slower processing speed than integer calculations.

However, the present exemplary embodiment is realized without a dramatic slowing down in the processing speed by setting a bit number larger than 8 bits for the second-stage output values so that the bit numbers which are larger than 8 bits are applied to the decimal portions. While how much the bit number is increased is determined according to designing, as illustrated in FIG. 15A, it can be designed by considering as a guide how much the actual input range has dropped compared with a normal case.

In the present exemplary embodiment, while other colors have 256 stages, C has 111 stages and the actual input range has worsened by 256/111, or 2.3. When the gradation correction is controlled by the bit number, similar result can be obtained if the bit number is increased by one or two bits (from twice to four times the stage numbers).

Further, since increase of the bit number slows the processing speed, the bit numbers of only the dots which are subject to air current limitation conditions are increased and a needless decrease in speed resulting from increasing the bit number for unnecessary colors can be prevented.

Further, for a device having a plurality of printing modes, there may be some modes which require air current limitation conditions, while other modes may not. In such a case, an unnecessary decrease in speed can be prevented by processing a printing mode which does not require the air current limitation conditions with the normal bit number, and switching the processing to use a larger bit number for a printing mode which requires the air current limitation conditions. At that stage, as described above, the bit number of the second-stage output values may be increased only for the necessary dots in the printing modes which require the air current limitation conditions.

However, since this may complicate the processing system, the processing system can be configured so that the bit number for all colors of the printing modes which require the air current limitation conditions is increased, and the bit number for the printing modes which do not require the air current limitation conditions is not increased. In such a case as well, the effect of being able to prevent a decrease in the processing speed for printing modes which do not require the air current limitation conditions can be realized.

In the above exemplary embodiment, an example is described for a case where the air current limitation conditions are generated for C and SC. However, the present invention is not limited to this combination. For example, the air current limitation conditions may be generated for M and SM.

Further, while the present exemplary embodiment is described for a case in which the size of the ink droplets has two-stage, the same effects can be obtained by the method according to the exemplary embodiment of the present invention even if the size of the ink droplets has three-stage or more. In such a case, color-separated output values of the second-stage for the same ink are set to have the same value for each dot, and in the subsequent gradation correction table, a table based on the limitation conditions between each of the dots may be set.

Further, the same method can be applied to cases where the air current limitation conditions are generated for same-color, different-density inks. For example, when there are air current limitation conditions between cyan ink with a dark density and cyan ink with a light density, the similar effects can be obtained by replacing each of these inks with the C dots and SC dots of the present exemplary embodiment.

Further, as illustrated in FIG. 10, even when the air current limitation conditions are different depending on the printing mode, an image which is optimized for each printing mode can be formed by changing the gradation correction table values for each of the printing modes.

Figure 18:
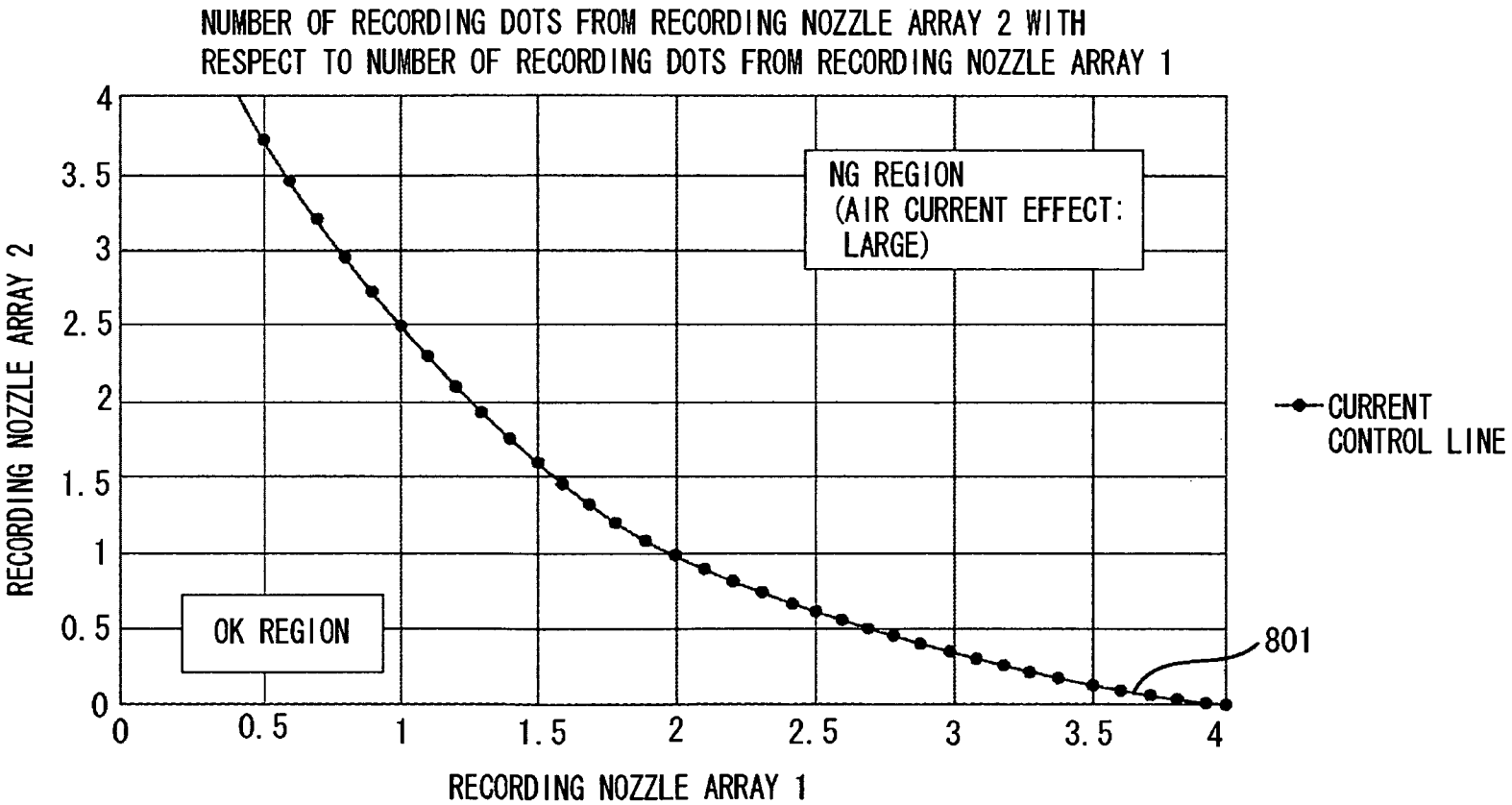
FIG. 18 illustrates a conventional air current control line.
Figure 19:
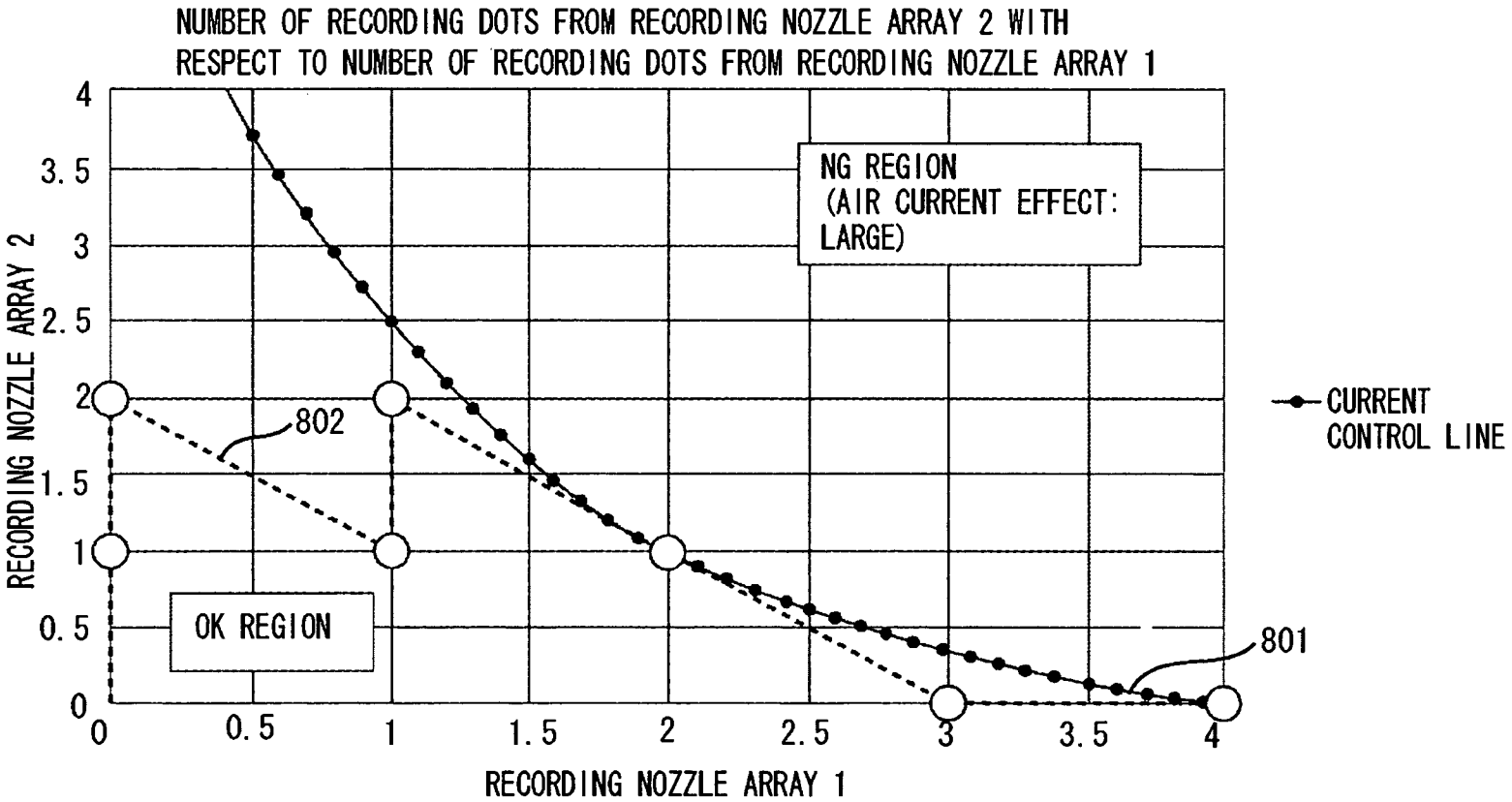
FIG. 19 illustrates the result of recording of the dots which are used during conventional air current control recording.
Figure 21A:
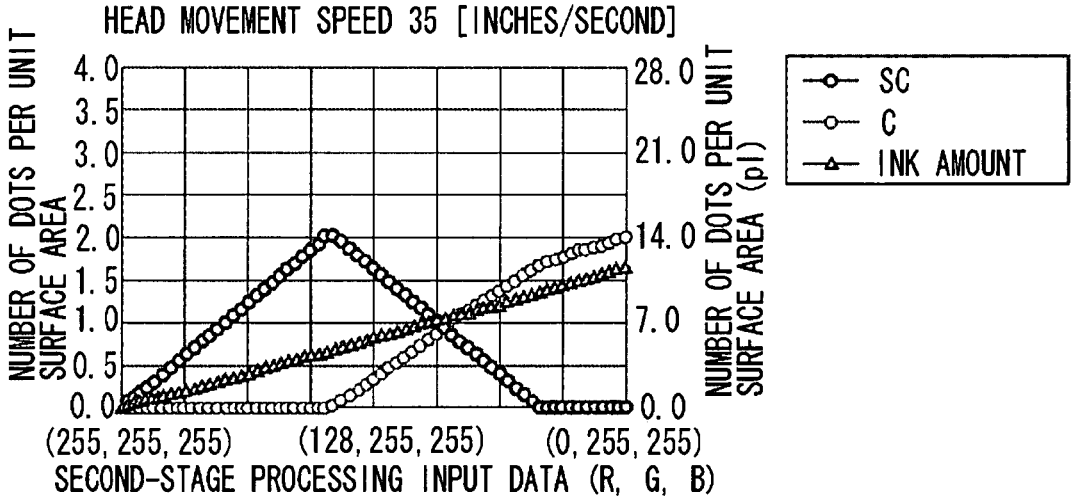
FIGS. 21A to 21C illustrate cases where conventional air current control is performed.
Figure 21B:
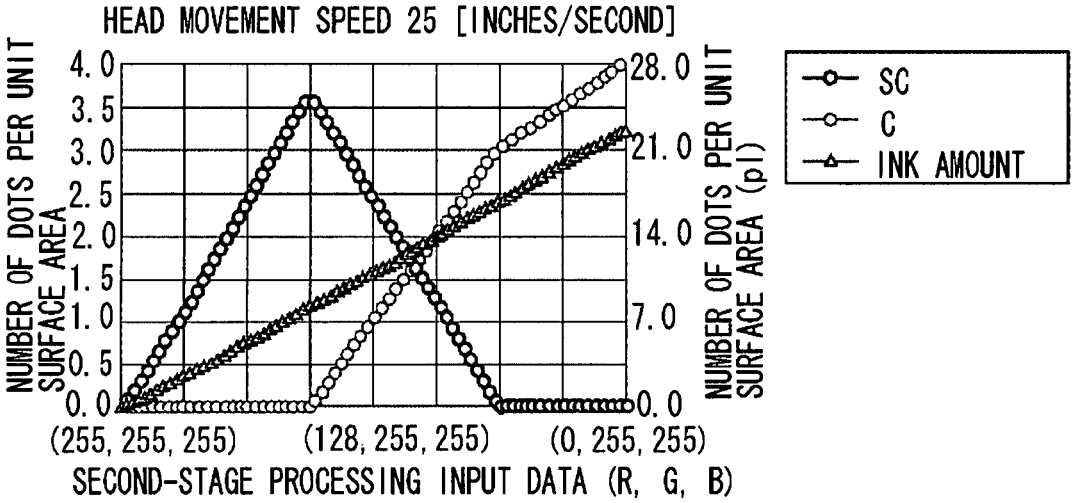
Figure 21C:
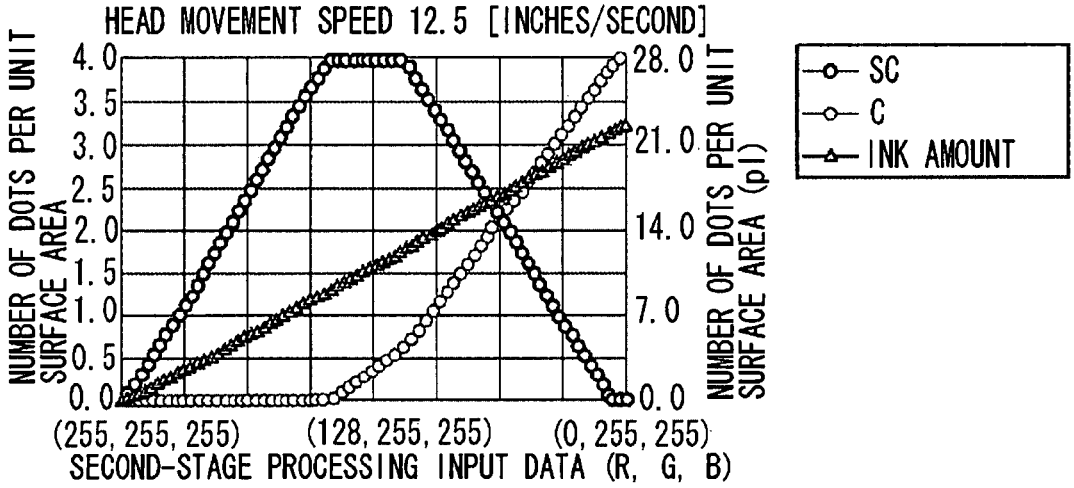

Further, in the description of the above present exemplary embodiment, an example is described in which the recording dots are set as close as possible to the air current limitation conditions. However, if there is a limitation on the number of recording dots between the plurality of nozzle arrays due to a factor other than the air current limitations, the techniques of the exemplary embodiment of the present invention can be applied based on the limitation. What is important is that the techniques of the exemplary embodiment of the present invention can be applied in cases where it is determined that a limitation is necessary on the number of recording dots between the plurality of recording nozzles as illustrated in FIGS. 10 and 18.

Although the present invention is described using an example of a combination of the host computer and the recording apparatus, the present invention can also be performed by a multifunction peripheral (MFP) which has a copying function, a printer function, a scanner function and the like. A hardware configuration of a MFP to which the present invention is applied can use conventional structures.

In the case of applying the present invention in the copying function of the MFP, the processing block of the host apparatus 1000 and the processing block of the recording apparatus 2000 in FIG. 8 both are processed by internal units in the MFP. For example, the processing of the application J0001 of FIG. 8 can be implemented by operating the scanner to read an original document and by generating sRGB data, then performing the processing of the printer driver processing blocks J0002 to J0006 using a CPU of the MFP or an image processing semiconductor integrated circuit (IC).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-057307 filed Mar. 7, 2008, which is hereby incorporated by reference herein in its entirety.

What is claimed is:

1. An image processing apparatus generating recording data for discharging ink droplets from a first nozzle and a second nozzle of a recording head, wherein the second nozzle is used for discharging smaller ink droplets than the ink droplet discharged from the first nozzle, for recording an image on a recording medium, the image processing apparatus comprising:

an obtaining unit configured to obtain image data indicating first multi-valued gradation values corresponding to an ink amount applied by the first nozzle onto a unit area of the recording medium and second multi-valued gradation values corresponding to an ink amount applied by the second nozzle onto a unit area of the recording medium, based on the input data of the image;

a correction unit configured to correct the first and second multi-valued gradation values of the image data obtained by the obtaining unit corresponding to the first nozzles and the second nozzles; and a generation unit configured to generate the recording data for the first nozzle based on the first multi-valued gradation values of the image data corrected by the correction unit and a first dot arrangement pattern representing a number of ink droplets per the unit area to be discharged from a first nozzle according to the first multi-valued gradation values and generate the recording data for the second nozzle based on the second multi-valued gradation values of the image data corrected by the correction unit and a second dot arrangement pattern representing a number of ink droplets per unit area to be discharged from a second nozzle according to the second multi-valued gradation values, wherein the correction unit corrects the first and second multi-valued gradation values such that the larger the second multi-valued gradation values are, the larger the number of ink droplets to be discharged to the unit area from the second nozzle, in a case where the second multi-valued gradation values of the number of ink droplets to be discharged to the unit area from the second nozzle are smaller than the second multi-valued gradation values which is a maximal number from among the number of ink droplets represented by the second dot arrangement pattern, ink droplets are not discharged to the unit area from the first nozzle, in a case where the second multi-valued gradation values of the number of ink droplets to be discharged to the unit area from the second nozzle are larger than the second multi-valued gradation values which is a maximal number from among the number of ink droplets represented by the second dot arrangement pattern, the number of ink droplets to be discharged to the unit area from the second nozzle steadily decreases in accordance with a situation that the second multi-valued gradation values become large, and in a case where ink droplets are discharged to the unit area from the first nozzle, the number of ink droplets to be discharged to the unit area from the second nozzle becomes smaller than a predetermined number which is smaller than the maximal number.

2. The image processing apparatus according to claim 1, wherein the multi-valued gradation values of the image data obtained by the obtaining unit corresponding to the first nozzles and the second nozzles are corrected with different correction amounts of the correction of the multi-valued gradation values by the correction unit.

3. The image processing apparatus according to claim 2, wherein the first nozzles and the second nozzles discharge ink droplets of the same color.

4. The image processing apparatus according to claim 1, wherein the recording is performed by scanning the unit area with the recording head at a predetermined relative speed, and the correction unit determines a correction amount of the correction of the multi-valued gradation values by the correction unit in accordance with the relative speed.

5. The image processing apparatus according to claim 1, wherein the multi-valued gradation values are obtained by performing an interpolation calculation using data indicating correspondence relationship between a predetermined number of the multi-valued gradation values and R, G and B signal values for obtaining the gradation values.

6. The image processing apparatus according to claim 1, wherein the multi-valued gradation values corresponding to the first nozzles indicated by the image data obtained by the obtaining unit are the same as the multi-valued gradation values corresponding to the second nozzles indicated by the image data obtained by the obtaining unit.

7. The image processing apparatus according to claim 6, wherein the correction unit corrects the multi-valued gradation values such that a number of ink droplets discharged from the first nozzles and a number of ink droplets discharged from the second nozzles indicated by the recording data generated by the generation unit are within a predetermined acceptable range.

8. The image processing apparatus according to claim 1, wherein the correction unit corrects the multi-valued gradation values such that a number of ink droplets discharged from the first nozzles and a number of ink droplets discharged from the second nozzles indicated by the recording data generated by the multi-valued generation unit are within a predetermined acceptable range.

9. The image processing apparatus according to claim 1, wherein the unit area is a dot area composed of 2×2.

10. The image processing apparatus according to claim 1, further comprising a mask unit configured to generate ejection data for each of scans in a case where the apparatus performs a plurality of scans of the recording head in the unit area to perform recording.

11. An image processing method for generating recording data for discharging ink droplets from a first nozzle and a second nozzle of a recording head, wherein the second nozzle is used for discharging smaller ink droplets than the ink droplet discharged from the first nozzle, for recording an image on a recording medium, the image processing method comprising:

obtaining image data indicating first multi-valued gradation values corresponding to an ink amount applied by the first nozzle onto a unit area of the recording medium and second multi-valued gradation values corresponding to an ink amount applied by the second nozzle onto a unit area of the recording medium, based on the input data of the image;

correcting the first and second multi-valued gradation values of the obtained image data corresponding to the first nozzles and the second nozzles; and generating the recording data for the first nozzle based on the first multi-valued gradation values of the image data corrected by the correcting step and a first dot arrangement pattern representing a number of ink droplets to be discharged from a first nozzle according to the first multi-valued gradation values and generating the recording data for the second nozzle based on the second multi-valued gradation values of the image data corrected by the correction unit and a second dot arrangement pattern representing a number of ink droplets to be discharged from a second nozzle according to the second multi-valued gradation values, wherein the correcting step includes correcting the first and second multi-valued gradation values such that the larger the second multi-valued gradation values are, the larger the number of ink droplets to be discharged to the unit area from the second nozzle, in a case where the second multi-valued gradation values of the number of ink droplets to be discharged to the unit area from the second nozzle are smaller than the second multi-valued gradation values which is a maximal number from among the number of ink droplets represented by the second dot arrangement pattern, ink droplets are not discharged to the unit area from the first nozzle, in a case where the second multi-valued gradation values of the number of ink droplets to be discharged to the unit area from the second nozzle are larger than the second multi-valued gradation values which is a maximal number from among the number of ink droplets represented by the second dot arrangement pattern, the number of ink droplets to be discharged to the unit area from the second nozzle steadily decreases in accordance with a situation that the second multi-valued gradation values become large, and in a case where ink droplets are discharged to the unit area from the first nozzle, the number of ink droplets to be discharged to the unit area from the second nozzle becomes smaller than a predetermined number which is smaller than the maximal number.

12. The image processing method according to claim 11, wherein the multi-valued gradation values of the image data obtained by the obtaining step corresponding to the first nozzles and the second nozzles are corrected with different correction amounts of the correction of the multi-valued gradation values by the correcting step.

13. The image processing method according to claim 12, wherein the first nozzles and the second nozzles discharge ink droplets of the same color and different volumes.

14. The image processing method according to claim 11, wherein the recording is performed by scanning the unit area with the recording head at a predetermined relative speed, and in the correcting step, the correction amount of the correction of the multi-valued gradation values by the correcting step is determined in accordance with the relative speed.

15. The image processing method according to claim 11, wherein the multi-valued gradation values are obtained by performing an interpolation calculation using data indicating correspondence relationship between a predetermined number of the multi-valued gradation values and R, G and B signal values for obtaining the gradation values.

16. The image processing method according to claim 11, wherein the multi-valued gradation values corresponding to the first nozzles indicated by the image data obtained by the obtaining step are the same as the multi-valued gradation values corresponding to the second nozzles indicated by the image data obtained by the obtaining step.

17. The image processing method according to claim 16, wherein the correction step includes correcting the multi-valued gradation values such that a number of ink droplets discharged from the first nozzles and a number of ink droplets discharged from the second nozzles indicated by the recording data generated by the generation step are within a predetermined acceptable range.

18. The image processing method according to claim 11, wherein the correction step includes correcting the multi-valued gradation values such that a number of ink droplets discharged from the first nozzles and a number of ink droplets discharged from the second nozzles indicated by the recording data generated by the multi-valued generating step are within a predetermined acceptable range.

19. The image processing method according to claim 11, wherein the unit area is a dot area composed of 2×2.

20. The image processing method according to claim 11, further comprising a mask unit configured to generate ejection data for each of scans in a case where the apparatus performs a plurality of scans of the recording head in the unit area to perform recording.

* * * * *